US011445279B2

(12) United States Patent
Liang et al.

(10) Patent No.: US 11,445,279 B2
(45) Date of Patent: Sep. 13, 2022

(54) AIR-PULSE GENERATING DEVICE AND SOUND PRODUCING METHOD THEREOF

(71) Applicant: xMEMS Labs, Inc., Santa Clara, CA (US)

(72) Inventors: Jemm Yue Liang, Sunnyvale, CA (US); Wen-Chien Chen, New Taipei (TW); Jye Ren, Taipei (TW)

(73) Assignee: xMEMS Labs, Inc., Santa Clara, CA (US)

( * ) Notice: Subject to any disclaimer, the term of this patent is extended or adjusted under 35 U.S.C. 154(b) by 0 days.

(21) Appl. No.: 17/553,813

(22) Filed: Dec. 17, 2021

(65) Prior Publication Data

US 2022/0224999 A1 Jul. 14, 2022

Related U.S. Application Data

(60) Provisional application No. 63/171,281, filed on Apr. 6, 2021, provisional application No. 63/143,510, filed on Jan. 29, 2021, provisional application No. 63/142,627, filed on Jan. 28, 2021, provisional application No. 63/139,188, filed on Jan. 19, 2021, provisional application No. 63/138,449, filed on Jan. 17, 2021, provisional application No. 63/137,479, filed on Jan. 14, 2021.

(51) Int. Cl.
*H04R 1/02* (2006.01)
*H04R 7/04* (2006.01)

(52) U.S. Cl.
CPC ..... *H04R 1/02* (2013.01); *H04R 7/04* (2013.01); *H04R 2400/11* (2013.01); *H04R 2400/13* (2013.01)

(58) Field of Classification Search
CPC ..... H04R 1/02; H04R 7/04; H04R 2400/11; H04R 2400/13
See application file for complete search history.

(56) References Cited

U.S. PATENT DOCUMENTS 4,646,733 A * 3/1987 Stroh ..... A61M 16/042 128/207.14
4,942,939 A * 7/1990 Harrison ..... H04R 1/2857 181/150

(Continued)

FOREIGN PATENT DOCUMENTS

WO WO-2016202790 A2 * 12/2016 ..... B81B 3/0021

OTHER PUBLICATIONS

Liang, the specification, including the claims, and drawings in the U.S. Appl. No. 17/553,806, filed Dec. 17, 2021.

(Continued)

*Primary Examiner* — Oyesola C Ojo
(74) *Attorney, Agent, or Firm* — Winston Hsu

(57) ABSTRACT

An air-pulse generating device includes a membrane structure, a valve structure, and a cover structure. A chamber is formed between the membrane structure, the valve structure and the cover structure. An air wave vibrating at an operating frequency is formed within the chamber. The valve structure is configured to be actuated to perform an open-and-close movement to form at least one opening. The at least one opening connects air inside the chamber with air outside the chamber. The open-and-close movement is synchronous with the operating frequency.

30 Claims, 15 Drawing Sheets

(56) References Cited

U.S. PATENT DOCUMENTS 5,109,948 A * 5/1992 Sandstrom ..... G10K 15/04 331/155
5,611,406 A 3/1997 Matsuzaki
7,736,324 B1 * 6/2010 Helgeson ..... A61H 23/04 248/161
10,425,732 B1 9/2019 Liang
2004/0024455 A1 * 2/2004 de Vries ..... A61F 2/203 623/9
2005/0235988 A1 * 10/2005 Hansen ..... F04B 35/06 128/200.24
2008/0121220 A1 * 5/2008 Wilder ..... F41H 13/00 124/77
2012/0018244 A1 * 1/2012 Robert ..... B06B 1/0292 181/142
2012/0081337 A1 4/2012 Camp, Jr
2013/0279738 A1 * 10/2013 Daley ..... H04R 19/02 381/423
2014/0064036 A1 * 3/2014 Tseng ..... G10K 7/00 367/190
2014/0084396 A1 * 3/2014 Jenkins ..... H04R 1/222 257/419
2014/0341394 A1 * 11/2014 Croft, III ..... H04R 3/002 381/102
2016/0059206 A1 3/2016 Chen
2016/0366521 A1 12/2016 Pinkerton, III
2017/0041708 A1 * 2/2017 Barzen ..... H04R 29/001
2018/0179048 A1 6/2018 Schenk
2019/0020944 A1 1/2019 Kubo
2019/0116417 A1 4/2019 Liang
2019/0238974 A1 * 8/2019 Hong ..... H04R 1/2811
2020/0059719 A1 2/2020 Liang
2022/0047841 A1 * 2/2022 Durán Vargas ..... A61H 9/0078

OTHER PUBLICATIONS

Liang, the specification, including the claims, and drawings in the U.S. Appl. No. 17/553,808, filed Dec. 17, 2021.

* cited by examiner

AIR-PULSE GENERATING DEVICE AND SOUND PRODUCING METHOD THEREOF

CROSS REFERENCE TO RELATED APPLICATIONS

This application claims the benefit of U.S. provisional application No. 63/137,479 filed on Jan. 14, 2021, No. 63/138,449 filed on Jan. 17, 2021, No. 63/139,188 filed on Jan. 19, 2021, No. 63/142,627 filed on Jan. 28, 2021, No. 63/143,510 filed on Jan. 29, 2021, and No. 63/171,281 filed on Apr. 6, 2021, which are incorporated herein by reference.

BACKGROUND OF THE INVENTION

1. Field of the Invention

The present application relates to an air-pulse generating device and a sound producing method thereof, and more particularly, to an air-pulse generating device and a sound producing method thereof capable of increasing overall air pulse rate, improving sound pressure level, and/or saving power.

2. Description of the Prior Art

Speaker driver and back enclosure are two major design challenges in the speaker industry. It is difficult for a conventional speaker to cover an entire audio frequency band, e.g., from 20 Hz to 20 KHz. To produce high fidelity sound with high enough sound pressure level (SPL), both the radiating/moving surface and volume/size of back enclosure for the conventional speaker are required to be sufficiently large.

Therefore, how to design a small sound producing device while overcoming the design challenges faced by conventional speakers is a significant objective in the field.

SUMMARY OF THE INVENTION

It is therefore a primary objective of the present application to provide an air-pulse generating device and a sound producing method thereof, to improve over disadvantages and/or restrictions of the prior art.

An embodiment of the present invention provides an air-pulse generating device, comprising a membrane structure and a valve structure; a cover structure, wherein a chamber is formed between the membrane structure, the valve structure and the cover structure; wherein an air wave vibrating at an operating frequency is formed within the chamber; wherein the valve structure is configured to be actuated to perform an open-and-close movement to form at least one opening, the at least one opening connects air inside the chamber with air outside the chamber; wherein the open-and-close movement is synchronous with the operating frequency.

Another embodiment of the present invention provides a sound producing method, applied in an air-pulse generating device, the method comprising forming an air wave within a chamber, wherein the air wave vibrates at an operating frequency, and the chamber is formed within the air-pulse generating device; and forming at least one opening on the air-pulse generating device at an opening frequency, wherein the at least one opening connects air inside the chamber with air outside the chamber; wherein the opening frequency is synchronous with the operating frequency.

These and other objectives of the present invention will no doubt become obvious to those of ordinary skill in the art after reading the following detailed description of the preferred embodiment that is illustrated in the various figures and drawings.

DETAILED DESCRIPTION

U.S. Pat. No. 10,425,732 provides a sound producing device, or an air-pressure-pulse-speaker (APPS), comprising a plurality of air pulse generating elements which is capable of producing a plurality of PAM (pulse-amplitude modulation) air pulses at an ultrasonic pulse rate, higher than a maximum human audible frequency. U.S. Pat. No. 10,425,732 also discloses that the APPS may function as a fan, which may be disposed within an electronic device and help on heat dissipation of the electronic device.

U.S. Pat. No. 10,771,893 provides a SEAM (single ended amplitude modulation) driving signal for a sound producing device, or an APPS, capable of producing single-ended PAM air pulses at ultrasonic pulse rate, in order to further enhance the sound pressure level performance and low audio frequency response. The SEAM driving signal comprises a plurality of electrical pulses, where the plurality of electrical pulses has the same polarity compared to (or with respect to) a certain voltage. For SEAM driving signal, each electrical pulse cycle comprises a PAM (pulse, amplitude-modulated) phase and an RST (reset) phase, which will be illustrated later on. The SEAM driving signal may be a PAM signal within the PAM phase and return to a reset voltage within the RST phase.

U.S. application Ser. No. 16/802,569 provides a sound producing device, or an APPS, which produces air pulses via chamber compression/expansion excited by membrane movement and the air pulses are propagated via through pressure ejection orifices (PEOs) formed either on the membrane or on a plate of the sound producing device, in order to achieve significant air pressure with small size/dimension of the sound producing device.

U.S. Pat. No. 11,043,197 provides an air pulse generating element and an APPS which utilize membrane to perform compression/expansion of the air within a chamber, and utilizes slits formed on the membrane to form virtual valves which may open temporarily to provide air shunt, such that an air pressure balancing process between two sides of membrane is accelerated.

In an embodiment, the air-pulse generating device of the present application may be applied in an APPS application, which is configured to produce PAM air pulses at an ultrasonic pulse rate according to APPS sound production principle. In another embodiment, the air-pulse generating device of the present application may be applied in an air movement or fan application, which functions as a fan and is similar to U.S. Pat. No. 10,425,732.

Figure 1:
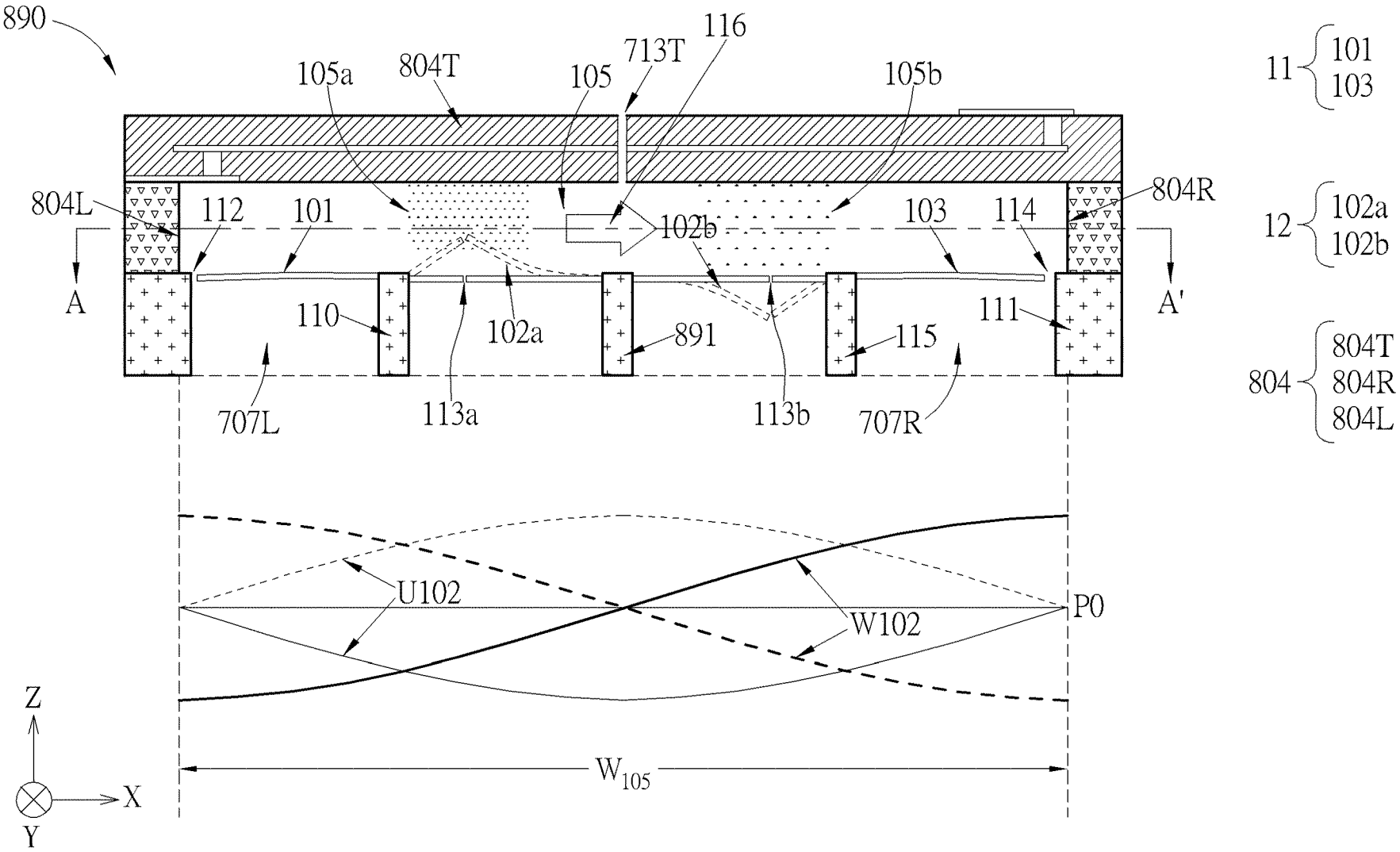
FIG. 1 is a schematic diagram of an air-pulse generating device according to an embodiment of the present application.

FIG. 1 is a schematic diagram of a cross sectional view of an air-pulse generating device 890 according to an embodiment of the present application. The air-pulse generating device 890 may be applied within an APPS. The air-pulse generating device 890 comprises a membrane structure 12, a valve structure 11 and a cover structure 804. A chamber 105 is formed between the membrane structure 12, the valve structure 11 and the cover structure 804. The air-pulse generating device 890 produces its (air pressure) output at ports 707L and 707R. FIG. 1 illustrates (solid outlines) the membrane structure 12 in a state in which the membrane structure 12 is (substantially) flat and parallel to XY-plane, and also illustrates (dashed outlines) the membrane structure 12 in an actuated state in which the membrane structure 12 is curved.

The membrane structure 12 and the valve structure 11 may have thin film structure, which may, e.g., be fabricated by MEMS (Micro-Electro-Mechanical System) fabrication process using SOI (silicon/Si of insulator) or POI (Poly-Si/polysilicon on insulator) wafers, but not limited thereto. In the embodiment shown in FIG. 1, the membrane structure 12 comprises a first membrane portion 102*a* and a second membrane portion 102*b*. The valve structure 11 comprises a first valve portion 101 and a second valve portion 103. The cover structure 804 comprises a top plate 804T and side walls 804L and 804R. The chamber 105 is surrounded by/between the membrane portions 102*a* and 102*b*, the valve portions 101 and 103, the top plates 804T, and the side walls 804L and 804R. Valve portion 101/103 is anchored to support structure 110/115 on one end and is free-moving on the other end, where the free-moving end is located close/next to side wall 804L/804R.

The membrane structure 12 is configured to be actuated, such that an air wave AW is produced. Furthermore, by carefully choosing driving signal(s) fed to the membrane structure 12, the air wave AW may vibrate at an operating frequency $f_{CY}$ and propagates along with a direction (e.g., X-direction) parallel to the membrane structure 12 within the chamber 105.

In a perspective, air wave may be related that the mass of air molecules periodically moves in a back-and-forth direction (e.g., left-and-right in X-direction, in view of X-axis components movement) at a certain time period due to air pressure variation or variation of air-molecule density. Air wave vibrating at a certain frequency may be related to the operating frequency $f_{CY}$ that the certain frequency is a reciprocal of the certain time period, and vice versa.

The valve structure 11 is configured to be actuated to perform an open-and-close movement, at an opening frequency, to form at least one opening periodically, where the at least one opening connects the air inside the chamber 105 with the ambient/air outside the chamber 105. Specifically, the valve portion 101 may be actuated to perform an up-and-down movement (in the Z direction) which cause an opening 112 to form-and-unform, and this is referred to as the open-and-close of valve 101. Similarly, the valve portion 103 may be actuated to perform an up-down movement (in the Z direction) which cause an opening 114 to form-and-unform, and this is referred to as the open-and-close of valve 103. The open-and-close movements of the valve structure 11, including the valve (portions) 101 and 103, (or the opening frequency) would be synchronous with the air wave AW, which is further synchronous with the operating frequency $f_{CY}$. The open-and-close movements of the valve structure/portion being synchronous with the operating frequency $f_{CY}$ means that, the open-and-close movements of the valve portion/structure is performed (preferably) at the operating frequency $f_{CY}$, or at a frequency of $(M/N)*f_{CY}$, wherein both M and N are integers. The open-and-close, up-and-down, form-and-unform movement will be elaborated later. In the following description, the valve portion 101/103 may be referred to the valve 101/103 for brevity.

The function of valve opening is similar to that of a variable resistor whose resistance to airflow, $Z_{VALVE}$, is controlled by the degree of the valve opening. When the valve is closed, i.e. $Z101<Z_{O/C}$ or $Z103<Z_{O/C}$, the magnitude of $Z_{VALVE}$ will be high (Hi-Z). When the valve is opened, i.e. $Z101>Z_{O/C}$ or $Z103>Z_{O/C}$, the magnitude of $Z_{VALVE}$ will be inversely related to the degree of opening, or $Z101-Z_{O/C}$ or $Z103-Z_{O/C}$. The wider a valve is opened, the lower the value of $Z_{VALVE}$ will be and the higher the airflow will be for any given chamber pressure.

Chamber Resonance

Note that, given the side walls 804L and 804R may serve as reflection walls, the air wave AW generated by the membrane structure 12 may comprise an incident wave and a reflected wave. In an embodiment, a width of the chamber 105, denoted as $W_{105}$, or a distance between the side walls 804L and 804R, may be designed such that, the incident wave and the reflected wave may be aggregated and form a standing wave within the chamber 105.

In an embodiment, the distance between the side walls 804L and 804R or the width $W_{105}$ may equal to an integer multiple of a half wavelength ($\lambda/2$) corresponding to the operating frequency $f_{CY}$ of the air wave AW, $\Delta=C/f_{CY}$, where C is the speed of sound.

In an embodiment, the distance between the side walls 804L and 804R or the width $W_{105}$ may be designed such that, a $1^{st}$ mode (or n=1 mode) resonance, also called fundamental mode resonance or $1^{st}$ harmonic resonance, is formed within the chamber 105. In this case, only 1 air-motion antinode (amplitude reaches peak) exists within the chamber 105 (which may be at a center of the chamber 105); only 2 air-motion nodes (amplitude near 0) locate at the side walls 804L and 804R; only 1 air-pressure node exists within the chamber 105 (which may be at the center of the chamber 105); only 2 air-pressure antinodes locate at the side walls 804L and 804R.

Herein, in chamber resonance or standing wave perspective, the air-motion antinode represents position at which amplitude of air-molecule velocity/displacement achieves maximum in air-motion over X-axis within the chamber; the air-motion node represents position at which amplitude of air-molecule velocity/displacement achieves minimum in air-motion over X-axis within the chamber (usually 0 movement); the air-pressure antinode represents position at which amplitude of air pressure variation achieves maximum in air pressure over X-axis within the chamber; the air-pressure node represents position at which amplitude of air pressure variation achieves minimum in air pressure over X-axis within the chamber.

In FIG. 1, curves U102 schematically represent displacements of air particles distributed in the X-direction at different times, curves W102 schematically represent pressure distribution within the chamber at different times. For example, dashed lines of the curves U102 and W102 are corresponding to a time $t_0$ and solid lines of the curves U102 and W102 are corresponding to a time $t_1$. P0 in FIG. 1 may refer to an ambient pressure, which may be 1 atm. In an embodiment, to achieve $1^{st}$ mode (or n=1 mode) resonance, the distance between the between the side walls 804L and 804R or the width $W_{105}$ may be one half wavelength ($\lambda_{CY}/2$) corresponding to the operating frequency $f_{CY}$ of the air wave AW.

Figure 16:
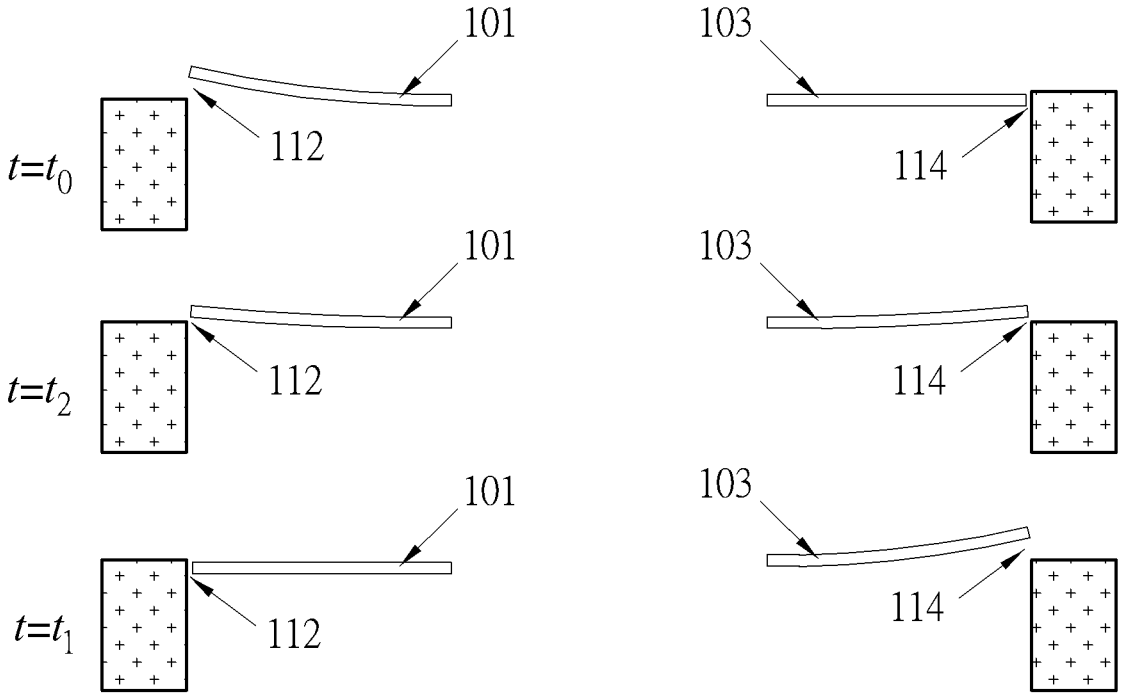
FIG. 16 is a schematic diagram of valve movement according to an embodiment of the present application.

Details of the valve movement of 101/103 are further illustrated in FIG. 16. At the time $t_0$ (or when $t=t_0$), the valve 101 is actuated to bend upward such that the opening 112 is opened or formed, and the valve 103 may be actuated to (substantially) seal the opening 114, which means that the opening 114 is closed or unformed, as shown in the top of FIG. 16. On the other hand, at the time $t_1$ (or when $t=t_1$), the valve 101 may be actuated to (substantially) seal the opening 112, which means that the opening 112 is closed or unformed, and the valve 103 is actuated to bend upward such that the opening 114 is opened or formed, as shown in the bottom of FIG. 16. In an embodiment, at some time $t_2$ (or when $t=t_2$, where $t_2 \neq t_0$ and $t_2 \neq t_1$), the valves 101 and 103 are in a state where the openings 112 and 114 are barely opened or barely closed, as shown in the middle of FIG. 16, corresponding to Z101=$Z_{O/C}$ and Z103=$Z_{O/C}$ as shown in FIG. 2 respectively.

Figure 2:
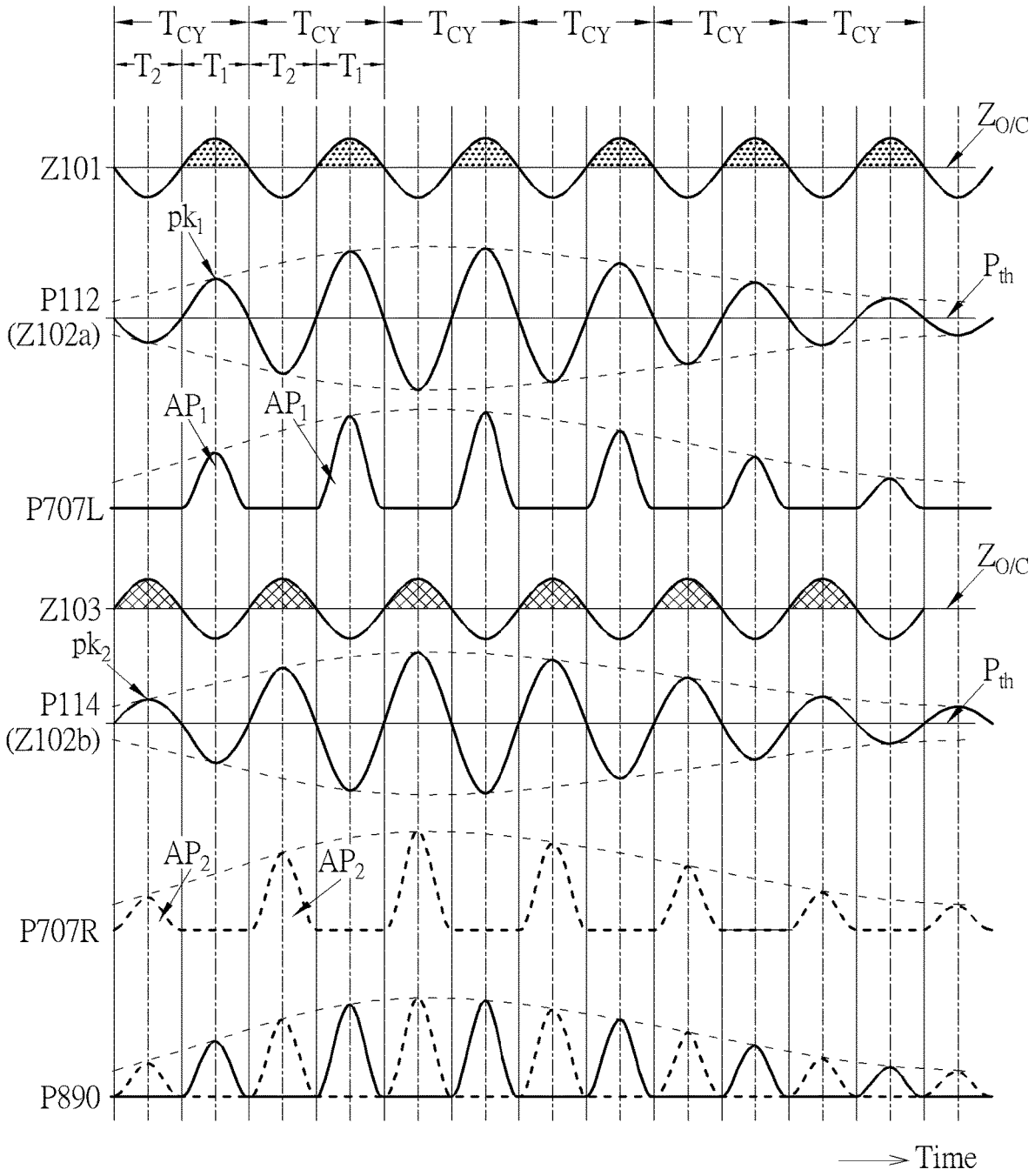
FIG. 2 is a schematic diagram of a plurality of waveforms according to an embodiment of the present application.

FIG. 2 is a schematic diagram of a plurality of waveforms according to an embodiment of the present application. Waveform Z101 schematically represents displacement in Z-direction of the free-moving end of valve portion 101; while waveform Z103 schematically represents displacement in Z-direction of the free-moving end of valve portion 103. $Z_{O/C}$ represents a certain level of displacement, and the suffix O/C stands for a line separating the open-state from the close-state. When the displacement of the free-moving end of valve Z101 is larger than (above) the displacement level $Z_{O/C}$, the opening 112 is formed or the valve 101 is opened. When the displacement of the free-moving end of valve Z103 is larger than the displacement level $Z_{O/C}$, the opening 114 is formed or the valve 103 is opened. When the displacement of the free-moving end of valve Z101 is less than (below) the displacement level $Z_{O/C}$, the opening 112 is not formed or the valve 101 is closed. When the displacement of the free-moving end of valve Z103 is less than the displacement level $Z_{O/C}$, the opening 114 is not formed or the valve 103 is closed.

Waveform P112 schematically represents air pressure at the opening 112 (within the chamber 105). Waveform P114 schematically represents air pressure at the opening 114 (within the chamber 105). Waveform Z102*a* represents displacement of the membrane portion 102*a*, which may share similar waveform with P112. Waveform Z102*b* represents displacement of the membrane portion 102*b*, which may share similar waveform with P114. Waveform P707L schematically represents air pressure (or quantity analogous to air pressure) at the port 707L (out of the chamber 105). Waveform P707R schematically represents air pressure (or quantity analogous to air pressure) at the port 707R (out of the chamber 105). Waveform P890 represents a sum/superposition of P707L and P707R, corresponding to an aggregated on-axis output acoustic pressure of the device 890. Waveform Z102*a*/Z102*b* whose unit is length, such as μM, generally has different amplitude from waveform P112/P114 whose unit is pressure, such as Pa. However, since the purpose of FIG. 2 is mainly to illustrate the timing relationship between different parts of the operation, these waveforms are merged in FIG. 2 for brevity.

Figure 3:
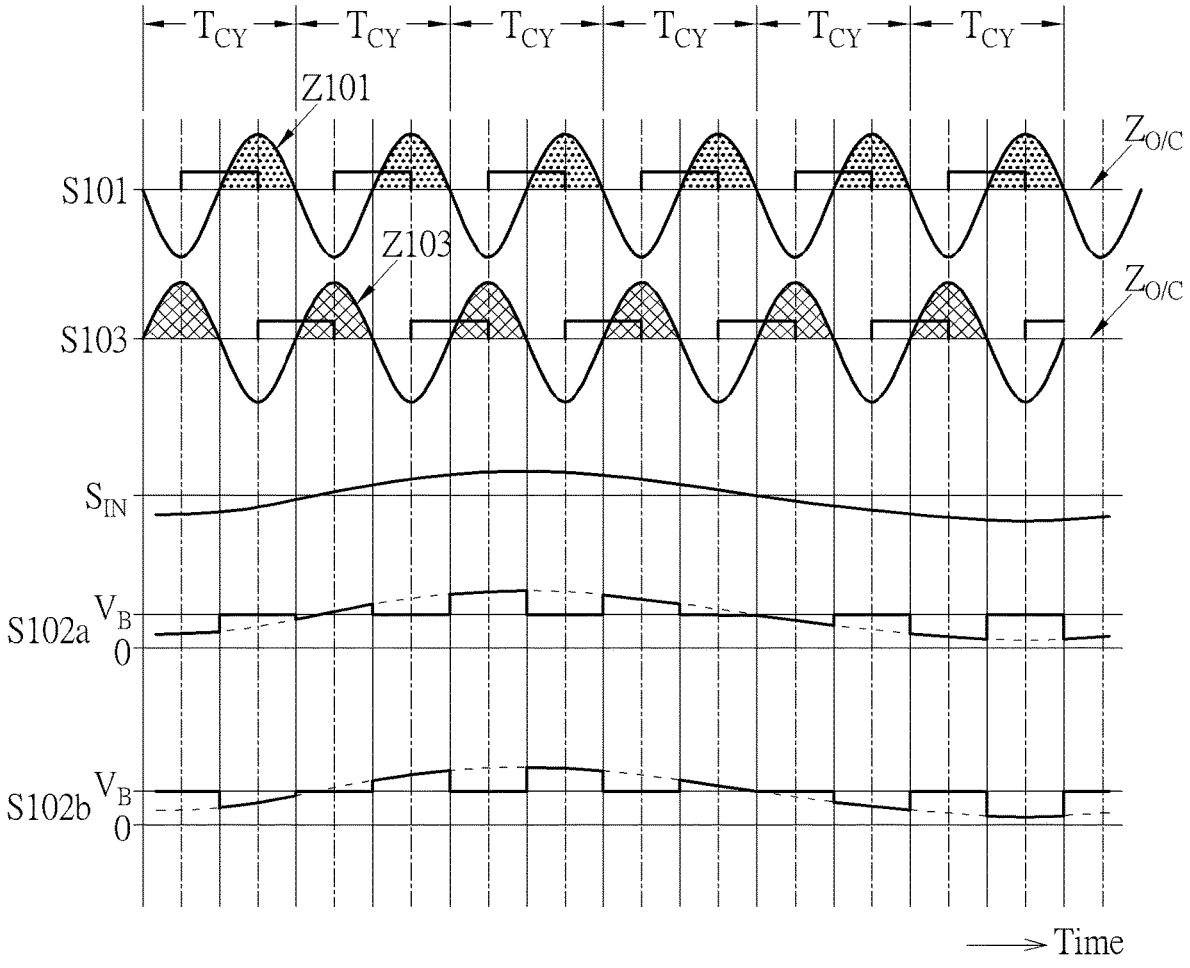
FIG. 3 is a schematic diagram of a plurality of signals according to an embodiment of the present application.

FIG. 3 is a schematic diagram of a plurality of signals according to an embodiment of the present application. $S_{IN}$ represents an input audio signal. S101/S103 represents a valve driving signal configured to drive the valve portion 101/103. S102*a*/S102*b* represents a membrane driving signal configured to drive the membrane portion 102*a*/102*b*.

AM Modulation Waveform

As can be seen from the plots/waveforms P112 and P114 in FIGS. 2, P112 and P114 are/comprise amplitude-modulated waveforms, and amplitude-modulated waveform P112/P114 may be expressed as a product of a carrier component and a modulation component, in general. The carrier component, usually expressed as $\cos(2\pi f_{CY} t)$, oscillates at the operating frequency $f_{CY}$, where $f_{CY}=1/T_{CY}$, where $T_{CY}$ denotes an operating cycle. The modulation component, may be expressed as m(t), is reflected by an envelope of the amplitude-modulated waveform (denoted by dotted envelope-curves in FIG. 2 and FIG. 3) which is corresponding to the input audio signal $S_{IN}$. In an embodiment, the modulation component m(t) may be corresponding or proportional to the input audio signal $S_{IN}$.

The amplitude-modulated waveform P112/P114 may be achieved by driving the membrane structure 12 by pulse-amplitude modulated driving signal. For example, the membrane driving signal S102*a*/S102*b* shown in FIG. 3 driving the membrane portion 102*a*/102*b* are pulse-amplitude modulated signal, generated according to the input audio signal $S_{IN}$.

Membrane Driving Signal

In other words, the membrane driving signal S102*a* comprises a first pulse-amplitude modulated (PAM) signal comprising a plurality of first pulses with respect to a certain bias voltage $V_B$. The first pulses are temporally distributed/arranged by the operating frequency $f_{CY}$. Similarly, the membrane driving signal S102*b* comprises a second PAM signal comprising a plurality of second pulses with respect to the bias voltage $V_B$. The second pulses are temporally distributed/arranged by the operating frequency $f_{CY}$.

In addition, the first pulses comprise first transition edges; while the second pulses comprise second transition edges. The first transition edges of the first pulses within the PAM signal S102*a* coincide with the second transition edges of the second pulses within the PAM signal S102*b*. Furthermore, at a certain coincidence time of the first transition edge and the second transition edge, the first transition edge is corresponding to a first transition polarity, and the second transition edge is corresponding to a second transition polarity. The first transition polarity is opposite to the second transition polarity, at the certain coincidence time. Details of the coincidence of the first and second transition edges and the opposition of the first and second transition polarities may be referred to FIG. 3 of the present application, or also be referred to U.S. Pat. Nos. 11,043,197 or 11,051,108, which are not narrated herein for brevity.

Figure 4:
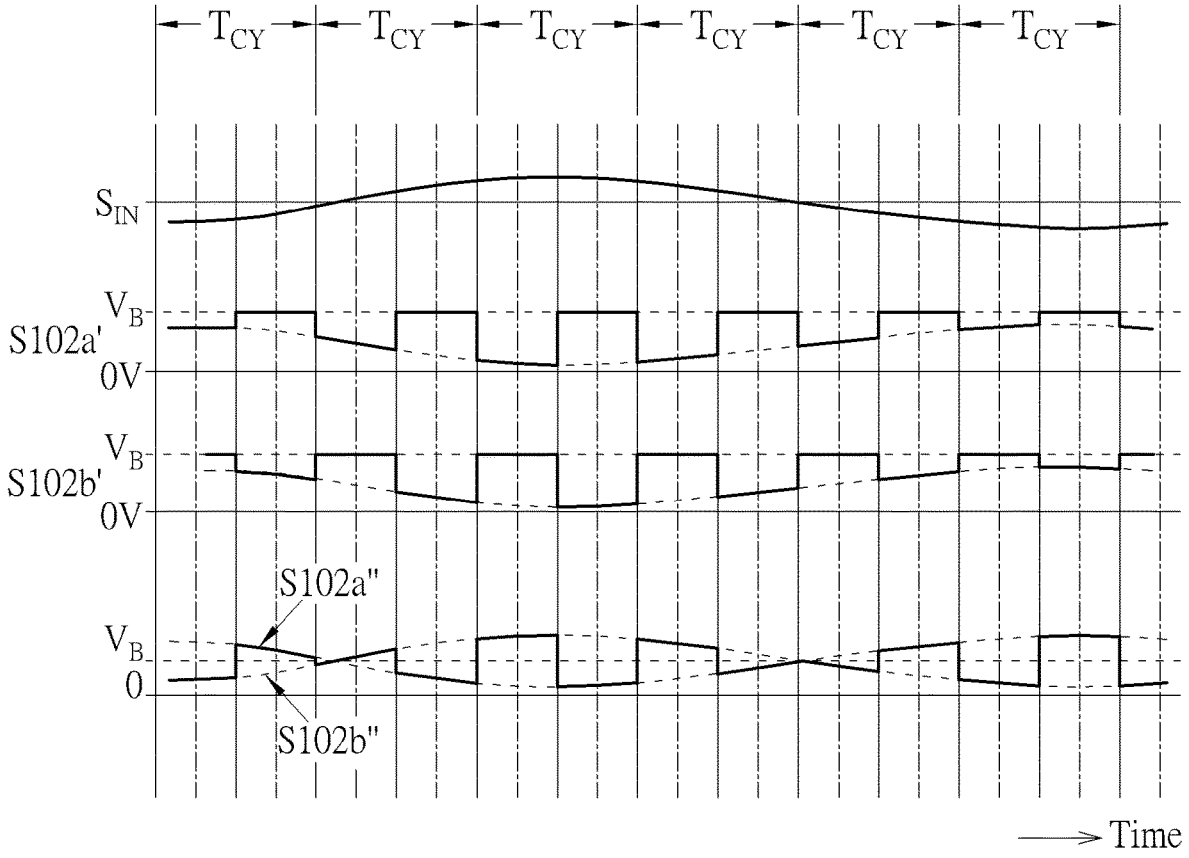
FIG. 4 illustrates membrane driving signals according to an embodiment of the present application.

Note that, the membrane driving signal S102*a*/S102*b* driving the membrane portion 102*a*/102*b* is bipolar (or double-ended) with respect to the bias voltage $V_B$, which is not limited thereto. For example, FIG. 4 illustrates a $2^{nd}$ type of membrane driving signals S102*a*' and S102*b*'. The membrane portions 102*a* and 102*b* may be driven by the membrane driving signals S102*a*' and S102*b*', respectively. Note that, the membrane driving signals S102*a*' and S102*b*' are SEAM driving signals, which are unipolar with respect to the bias voltage $V_B$. Similar to the unipolar membrane driving signals S102*a* and S102*b*, first pulses within the driving signal S102*a*' and second pulses within the driving signal S102*b*' are mutually interleaved, and have coincidence transition edges and opposite transition polarities, as shown in FIG. 4. Details of the unipolar SEAM driving signal may be referred to U.S. Pat. No. 10,771,893, which are not narrated herein for brevity.

FIG. 4 also illustrates a 3$^{rd}$ type of membrane driving signals S102*a*" (solid line in the bottom) and S102*b*" (dashed line in the bottom, together with S102*a*"). In an embodiment, the membrane portion 102*a* may be driven by the membrane driving signal S102*a*" and the membrane portion 102*b* may be driven by the membrane driving signal S102*b*". The driving signal S102*b*" may be obtained from S102*a*" according to equations expressed as S102*b*"=$V_B$−S102*a*" (eq. 1) or S102*b*"=−S102*a*" (eq. 2). In other words, a sum of the membrane driving signals S102*a*" and S102*b*" may be a constant. The constant may be the voltage level $V_B$ (if eq. 1 is applied) or 0V (if eq. 2 is applied). Similar to the membrane driving signals S102*a* and S102*b*, first pulses within the driving signal S102*a*" and second pulses within the driving signal S102*b*" have coincidence transition edges and opposite transition polarities, which may be observed from FIG. 4.

Furthermore, in an embodiment, pulses of/within the membrane driving signal S102*a*" may have alternating polarities with respect to a constant voltage (e.g., the bias voltage $V_B$). That is, one negative pulse (with respect to the bias voltage $V_B$) may be followed by a consecutive positive pulse (with respect to the bias voltage $V_B$), and the positive pulse may be followed by another consecutive negative pulse, as shown in FIG. 4. Similarly, pulses of/within the membrane driving signal S102*b*" also have alternating polarities with respect to the constant voltage.

Pressure Gradient

In one perspective, during a first interval (which may be a first half of the operating cycle $T_{CY}$), by applying the membrane driving signal pair (S102*a*, S102*b*)/(S102*a*', S102*b*')/(S102*a*", S102*b*") to the membrane portions 102*a* and 102*b*, the membrane portions 102*a* may be actuated to move toward a positive Z direction and the membrane portions 102*b* may be actuated to move toward a negative Z direction. Hence, during the first interval, the membrane portion 102*a* may be actuated to compress a first part/volume 105*a* (on top of the membrane portion 102*a*) within the chamber 105 and the membrane portions 102*b* may be actuated to expand a second part/volume 105*b* (on top of the membrane portion 102*b*) within the chamber 105, such that a first air pressure gradient (indicated by the block arrow 116 in FIG. 1) is formed from the first part/volume 105*a* toward the second part/volume 105*b*.

Conversely, during a second interval (which may be a second half of the operating cycle $T_{CY}$), the membrane portions 102*b* may be actuated to move toward the positive Z direction and the membrane portions 102*a* may be actuated to move toward the negative Z direction. Hence, during the second interval, the membrane portion 102*b* may be actuated to compress the second part/volume 105*b* and the membrane portions 102*a* may be actuated to expand the first part/volume 105*a*, such that a second air pressure gradient (opposite to 116, not shown in FIG. 1) is formed from the second part/volume 105*b* toward the first part/volume 105*a*.

A pressure-gradient direction of the air pressure gradient (e.g., 116 shown in FIG. 1) generated by the membrane structure 12, including the membrane portions 102*a* and 102*b*, is parallel to the X-direction shown in FIG. 1. A propagation direction of the air wave AW propagating within the chamber 105 is also parallel to the X-direction. That is, the pressure-gradient direction is parallel to the air-wave propagation direction. In addition, the pressure-gradient direction, which is parallel to the X-direction, is perpendicular to a membrane displacement direction of the membrane structure 12, largely in the Z-direction, wherein the membrane displacement direction refers to a direction which the membrane is actuated to move toward. Therefore, the pressure-gradient direction is parallel to the XY-plane, the plane of the membrane structure, and is orthogonal to the direction of the membrane displacements (Z). By taking the membrane structure being actuated or deformed into consideration, the pressure-gradient direction (generated by the membrane structure) may be regarded as being substantially parallel to the membrane structure and/or substantially perpendicular/orthogonal to the direction of the membrane displacements/movement.

Spatial Location of Valve Opening

When a standing wave is formed within chamber 105, in order to enhance the acoustic output efficiency, the opening(s) is suggested to be located at or near the air-pressure antinode(s) of the standing wave. For the air-pulse generating device 890, the opening may be formed spatially on a location where a peak of the air/standing wave is achieved, wherein the peak of the air/standing wave herein may be in terms of air pressure (for APPS application).

For APPS application, suppose that air pressure within the chamber may be expressed as a single-variable function p(x) or a two-variable function p(x, t), where x denotes variable in X-axis and t denotes variable in time-axis. The peak may be corresponding to a place where the 1$^{st}$ order (partial) derivative being zero, i.e., dp(x)/dx=0 or ∂p(x, t)∂=0 (to seek optimum spatial location of valve opening). In other words, (for some fixed time $t_0$) the peak may be interpreted as a local maximum or a local minimum of p(x)/p(x, $t_0$) over x-axis.

In this case, for the air-pulse generating APPS device 890, the openings 112 and 114 are formed near the side walls 804L and 804R, since the air-pressure antinodes of standing wave will be located at the side walls 804L and 804R.

Temporal Alignment of Valve Opening

In another aspect, in order to enhance the air pulse generation efficiency, the timing of valve opening(s) is suggested to be formed during an interval in which a peak pressure of the air wave is achieved at the locations of the valve opening, such as illustrated by 112 and 114 of FIG. 1. The peak pressure timing herein may be corresponding to a time at which the 1$^{st}$ order (partial) time derivative is zero, i.e., dp(t)/dt=0 or ∂p(x, t)/∂t=0 (to seek optimum timing, i.e., temporal behavior, of valve opening), given that air pressure within the chamber may be expressed as a single-variable function p(t) or the two-variable function p(x, t). In other words, (for some fixed location $x_0$, $x_0$ may be the location of valve opening 112 or 114) the peak may be interpreted as a local maximum or a local minimum of p(x)/p($x_0$, t) over t-axis.

For example, referring to FIG. 2, time intervals of the opening 112 being formed (i.e., the valve portion 101 being actuated to be opened or the valve 101 being opened) is illustrated as dotted regions in the plot Z101; time intervals of the opening 114 being formed (i.e., the valve portion 103 being actuated to be opened or the valve 103 being opened) is illustrated as cross hatched regions in the plot Z103. The opening 112 is formed during a (first) interval $T_1$; while the opening 114 is formed during a (second) interval $T_2$. Both intervals $T_1$ and $T_2$ may lie within the operating cycle $T_{CY}$, meaning that $T_1 \leq T_{CY}$, $T_2 \leq T_{CY}$ and $T_1+T_2 \leq (1+d) \times T_{CY}$, where $T_{CY}=1/f_{CY}$ and $d<0.5$.

To enhance efficiency, the first opening 112 is formed within the first interval $T_1$ during which a first peak pressure $pk_1$ of the air wave AW at a first location (corresponding to the sidewall 804L) is achieved; the second opening 114 is formed within the second interval $T_2$ during which a second peak pressure $pk_2$ of the air wave AW at a second location is achieved.

In one perspective, the opening frequency of the valves 101 and 103 equals the operating frequency $f_{CY}$, in the embodiment shown in FIG. 2.

Note that, in the embodiment illustrated in FIG. 2, the first interval $T_1$ (representing the opening interval of the valve 101) covers one half of the operating cycle $T_{CY}$, and the second interval $T_2$ (representing the opening interval of the valve 103) covers another half of the operating cycle $T_{CY}$, meaning that $T_1=T_2 \approx T_{CY}/2$ (i.e., let a length of interval $T_y$ be equal to half the length of the operating cycle $T_{CY}$, then $T_y \approx T_1$ or $T_y \approx T_2$), which is not limited thereto. The interval $T_1$ or $T_2$ may be slightly shorter or longer than $T_{CY}/2$ (for example, within ±10% or ±20%). As long as the opening interval of the valve 101 covers the first peak $pk_1$ and the opening interval of the valve 103 covers the second peak $pk_2$, the requirements of present application are satisfied, which is within the scope of the present application.

Furthermore, the first interval $T_1$ (representing the opening interval of the valve 101) may cover a first over/under-pressure interval during which air pressure P112, produced by the membrane movement, is greater/smaller than a certain pressure $P_{th}$, where the first over/under-pressure interval overlaps with $T_1$ in the embodiment illustrated in FIG. 2. Similarly, the second interval $T_2$ (representing the opening interval of the valve 103) may cover a second over/under-pressure interval during which air pressure P114, produced by the membrane movement, is greater/smaller than the certain pressure $P_{th}$, where the second over/under-pressure interval overlaps with $T_2$ in the embodiment illustrated in FIG. 2. In this case, the air-pulse generating device 890 generate positive/negative air pulses during the valve opening intervals $T_1$ and $T_2$, where the positive/negative air pulses herein may be propagated from the chamber 105 to ambient during the valve opening interval(s).

Note that, the AW pressure wave generated by driving waveform S102*a*'/S102*b*' of FIG. 4 will be simple AM while the AW pressure wave generated by driving waveform S102*a*/S102*b* of FIG. 3 or S102*a*"/−S102*a*" of FIG. 4 will be DSB-SC (double-sideband, suppress carrier). The timing relationship shown in FIG. 2 corresponds to a simple AM modulated AW pressure wave and peaks pk1, pk2 will not cross the line of $P_{th}$. However, for DSB-SC modulated AW pressure wave, pk1, pk2 will cross the line of $P_{IE}$ whenever the polarity of $S_{IN}$ changes, at which time over-pressure becomes under-pressure and vice versa.

Note that, the total pressure within the chamber may have two component pressures: one is produced by the membrane movement, the other is produced by the valve movement. Either of both components may be in the form of standing wave. The pressures P112 and P114 shown in FIG. 2 only refer to component pressures produced by the membrane movements.

Synchronous Valve Opening

Furthermore, the valve portion 101 may form the opening 112 in/during a plurality of first valve opening intervals, and the air pressure P112 may be greater than the certain pressure $P_{th}$ in/during a plurality of first over-pressure intervals. In the embodiment shown in FIG. 2, the plurality of first valve opening intervals (of the valve 101) and the plurality of first over-pressure intervals (of pressure P112) are temporally aligned or overlapped, where the first valve opening intervals (of the valve 101) and the first over-pressure intervals (of pressure P112) are annotated as $T_1$ in FIG. 2.

Similarly, the valve portion 103 may form the opening 114 in/during a plurality of second valve opening intervals and the air pressure P114 may be greater than the certain pressure $P_{th}$ in a plurality of second over-pressure intervals. The plurality of second valve opening intervals (of the valve 103) and the plurality of second over-pressure intervals (of pressure P114) may be also temporally aligned or overlapped, where the valve opening intervals (of the valve 103) and the over-pressure intervals (of pressure P114) are annotated as $T_2$ as in FIG. 2.

In the present application, a plurality of first time intervals and a plurality of second time intervals being temporally aligned or overlapped may refer that, 1) the plurality of first time intervals and the plurality of second time intervals are temporally arranged (or temporally appear) at the same frequency; or 2) a first time interval and a second time interval with which the first time interval overlaps, forming an overlapped region, and a length of the overlapped region is at least 50% of a length of the first (or second) time interval.

By aligning the valve opening intervals and the over-pressure intervals, the air-pulse generating device 890 may produce a plurality of first air pulses $AP_1$ (shown as P707L in FIG. 2) at the port 707L via the opening 112, and produce a plurality of second air pulses $AP_2$ (shown as P707R in FIG. 2) at the port 707R via the opening 114. In addition, a time corresponding to the peak valve opening of Z101/Z103 is preferably aligned to a time corresponding to the peak pressure of P112/P114 produced by the membrane movement.

In different perspectives, $T_1$ in FIG. 2 may denote, respectively: the first valve opening intervals of the valve 101 (in Z101's perspective); first membrane movement intervals of the membrane portions 102*a* (in Z102*a*'s perspective) and 102*b* (in Z102*b*'s perspective), creating a pressure gradient (vector) directing from volume 105*a*, atop membrane portion 102*a*, towards volume 105*b*, atop membrane portion 102*b*; the first over-pressure intervals (in P112's perspective); and first duty periods of the first air pulses at port 707L, $AP_1$. Similarly, $T_2$ in FIG. 2 may denote, respectively: the second valve opening intervals of the valve 103 (in Z103's perspective); second membrane movement intervals of the membrane portions 102*a* (in Z102*a*'s perspective) and the membrane portion 102*b* (in Z102*b*'s perspective), creating a pressure gradient (vector) directing from volume 105*b*, atop membrane portion 102*b*, towards volume 105*a*, atop membrane portion 102*a*; the second over-pressure intervals (in P114's perspective), and second duty periods of the second air pulses at port 707R, $AP_2$.

FIG. 2 illustrates, the first valve opening intervals of the valve 101, the first chamber pressure gradient intervals, the movements of membrane portions 102*a* and 102*b*, the first over-pressure intervals and the first duty periods of the first air pressure pulses $AP_1$ are temporally aligned (peak-to-peak) and overlapped (period wise). Similarity, the second valve opening intervals of the valve 103, the second chamber pressure gradient intervals, the movements of membrane portions 102*a* and 102*b*, the second over-pressure intervals (in P114's perspective), and the second duty periods of the second air pressure pulses $AP_2$ are temporally aligned (peak-to-peak) and overlapped (period wise).

Combining Two Half-Wave Rectified Pulses into One Full-Wave Rectified Pulses

In a perspective, by comparing waveforms P112 and P707L, P707L may be interpreted as a half-wave rectified version of P112, rectified by the timing varying impedance associated with valve 101 movement Z101. Also, by comparing waveforms P114 and P707R, P707R may be interpreted as a half-wave rectified version of P114, rectified by the timing varying impedance associated with valve 103 movement Z103. The waveform P890, the summing the waveforms P707L and P707R and representing the on-axis output acoustic pressure of the device 890, may be interpreted as a full-wave rectified version of P112 or P114.

Referring to plot P707L, the plurality of first air pulses $AP_1$ are produced at a first (air) pulse rate $APR_1$ corresponding to the operating frequency $f_{CY}$. Referring to plot P707R, the plurality of second air pulses $AP_2$ are produced at a second (air) pulse rate $APR_2$ corresponding to the operating frequency $f_{CY}$.

Referring to plot P890, since the first plurality of air pulses $AP_1$ and the second plurality of air pulses $AP_2$ are temporally and mutually interleaved, it can be interpreted that the air-pulse generating device 890 produces a plurality of aggregated air pules AP. The plurality of aggregated air pules AP comprises the first air pulses $AP_1$ with the first pulse rate $APR_1$ and the second air pulses $AP_2$ with the second pulse rate $APR_2$. The aggregated air pules AP is produced at an overall (air) pulse rate PRO.

Under a condition of $APR_1=APR_2=f_{CY}$ as the embodiment illustrated in FIG. 2, the overall pulse rate PRO is twice of the pulse rate $APR_1$ (or $APR_2$). In other words, the overall pulse rate PRO is corresponding to twice of the operating frequency $f_{CY}$, i.e., $PRO=2*f_{CY}$, analogous to 60 Hz 110 VAC sine waveform will produce 120 Hz of half-sine waveform after being full-wave rectified.

Analogy to AM Radio Demodulation

In a perspective, the action of the membrane movement can be compared to the AM radio station which creates EM wave amplitude modulated by sound signal and radiates the AM EM wave into the air. Instead of EM wave, device 890 generates amplitude modulated ultrasound wave and transmits such AM ultrasound wave into chamber 105. Such ultrasound wave is further amplified, at the location of the valve, by the standing wave construct of chamber 105. The standing wave construct of chamber 105 is analogous to an EM waveguide where the signal strength is maximized by locating the port(s) at the node(s) and antinode(s) of the waveguide. The signal received at the location of the valve is then demodulated by the periodical operation of the valve(s), which is analogous to the synchronous local oscillator of an AM receiver, and the nonlinear characteristics of $Z_{VALVE}$, which is analogous to the mixer of an AM receiver and generate the output, P707R/P707R, by dividing P112/P114 by the impendence $Z_{VALVE}(t)$ of its corresponding valve.

As an example, supposed that the plots Z101, P112, Z103 and P114 are sinusoidal for simplicity, i.e., by virtue of interleaved driving signal S101, S103 we have Z101$\propto \sin(\omega t)$, Z103$\propto -\sin(\omega t)$; and in the example illustrated in FIG. 1, by virtue of n=1 standing wave, there will be a phase inversion between P112 and P114 and therefore we can express these two local pressure as P112$\propto S_{IN}\cdot\sin(\omega t)$, P114$\propto S_{IN}\cdot\sin(\omega t)$, where the negative sign "−" represent the 180° phase difference, and $\omega=2\pi f_{CY}$. Assuming $Z_{VALVE}\propto 1/(Z101-Z_{O/C})$ when Z101$>Z_{O/C}$ and $Z_{VALVE}=\infty$ otherwise, then P707L may be expressed as P707L$\propto S_{IN}\cdot\sin^2(\omega t)$ when Z101$>Z_{O/C}$ and P707L=0 otherwise. Likewise, P707R may be expressed as P707R$\propto S_{IN}\cdot\sin^2(\omega t)$ when Z103$>Z_{O/C}$ and P707R=0 otherwise. The quantity P890, being P707L+P707R, representing an acoustic sound produced by the device 890. After substituting P707L and P707R we get P890=P707L+P707R$\propto S_{IN}\cdot\sin^2(\omega t)$ for all time in which the device 890 operates.

Note that, when a DSB-SC AM radio waveform, which has a mathematical expression of $S_{IN}\cdot\sin(\omega t)$, is demodulated by a carrier signal $\sin(\omega t)$, generated by a synchronous local oscillator, with a multiplier, the result can be expressed as $S_{IN}\cdot\sin(\omega t)\cdot\sin(\omega t)=S_{IN}\cdot\sin^2(\omega t)$, which is exactly the same mathematical expression for P890 derived in the paragraph above.

As known by person having ordinary skill in the art, after multiplying the AM modulated signal/waveform $S_{IN}\cdot\sin(\omega t)$ by the demodulation signal $\sin(\omega t)$, ⅔ of the energy of the resulting signal (i.e., $S_{IN}\cdot\sin^2(\omega t)$) is in the baseband and ⅓ of the energy of the resulting signal is on a frequency band centered at twice of the carrier frequency, i.e., $2\cdot\omega$ or $2\cdot f_{CY}$. Illustratively, supposed that P890$\propto S_{IN}\cdot\sin^2(\omega t)=S_{IN}\cdot(\frac{1}{2}-\frac{1}{2}\cos(2\omega t))$ (eq. 3). The 1st term in eq. 3, $\frac{1}{2}\cdot S_{IN}$, represents demodulated component on the baseband; while the 2nd term in eq. 3, $\frac{1}{2}\cdot S_{IN}\cdot\cos(2\omega t)$, represents component in the ultrasonic band. As can be seen from eq. 3, a first energy of the 1st term within the baseband is twice of a second energy of the 2nd term. The baseband herein refers to a frequency band of the input audio signal $S_{IN}$, and this baseband covers/overlaps with human audible frequency band.

In FIG. 1 (or FIG. 6), material of oxide substrate underneath the valves 101, 103, the membrane portions 102*a*, 102*b* may be removed by photo lithography process/processes, and supports 110 and walls 111 may be formed. According to patterns of very fine lines, Si or POLY layer(s) may be etched to form openings/slits. Such slits create free moving ends on the valve 101/103 (e.g., these slits may form the opening 112/114 when the displacement of the free-moving ends of the valves exceed $Z_{O/C}$). Alternatively, slits can increase the compliance of the membrane portion 102*a*/102*b* (e.g., by forming slits 113*a*, 113*b* on the membrane portions 102*a*, 102*b*).

Figure 5:
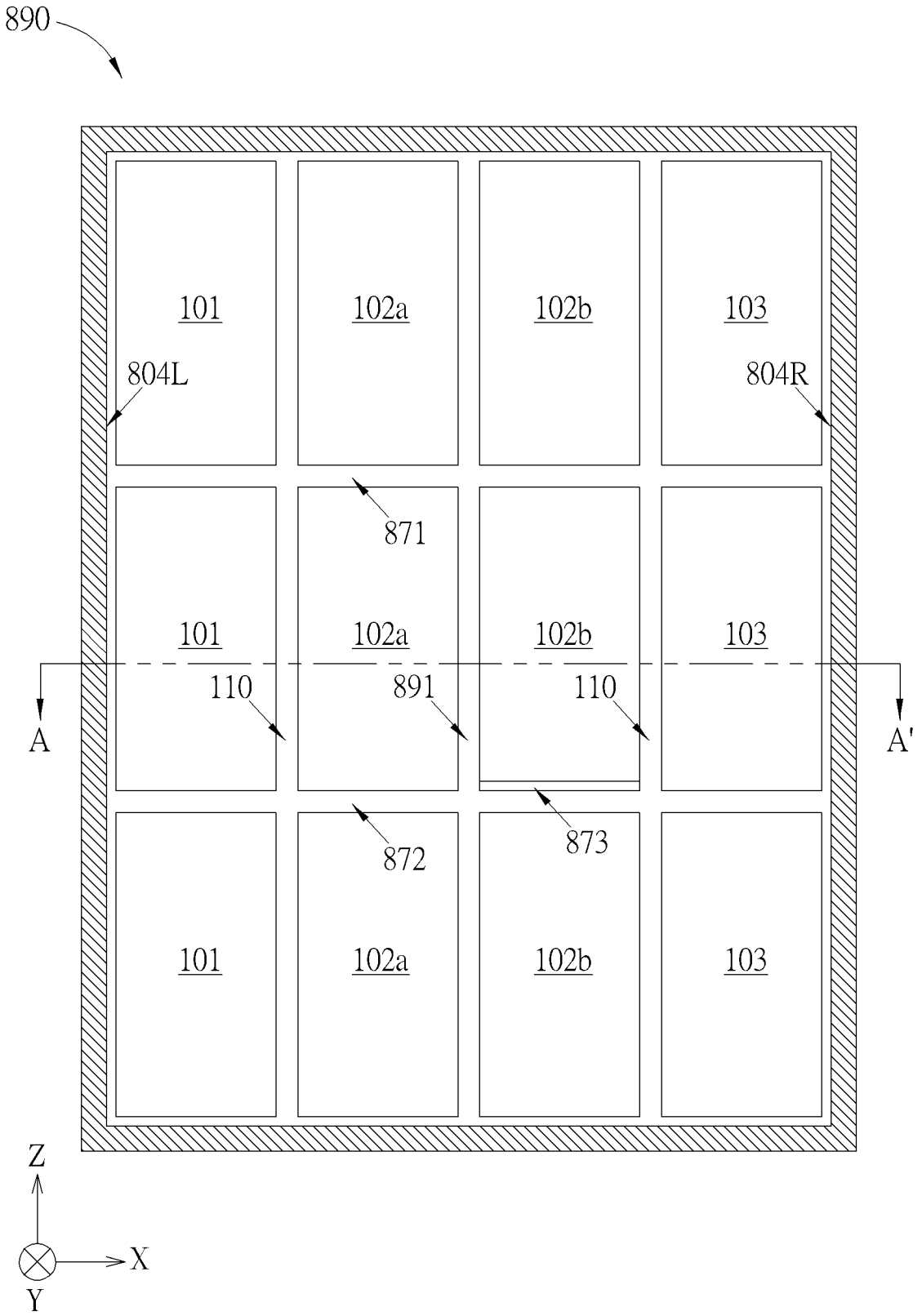
FIG. 5 is a schematic diagram illustrating a top view of the air-pulse generating device shown in FIG. 1.

FIG. 5 is a schematic diagram illustrating a top view of the air-pulse generating device 890 shown in FIG. 1. The air-pulse generating device 890 may (optionally) include cross linked beams 871, 872 to break down the (long) valves 101, 103 or the (long) membrane portions 102*a*, 102*b* into shorter pieces and to reinforce the supports 110 and 891. The air-pulse generating device 890 may (optionally) have slot(s) 873, which may be created by widening one slit on a membrane portion to function as an airflow pathway to allow pressure to be release. Herein, a slit generally has a width corresponding to the etching resolution of a MEMS fabrication process, such as a width of 0.5·1.8 μM over 3~7 μM-thick Si membrane; a slot refers to a line geometry width that is not restricted to the limits of the MEMS fabrication process.

Higher Harmonics

Figure 7:
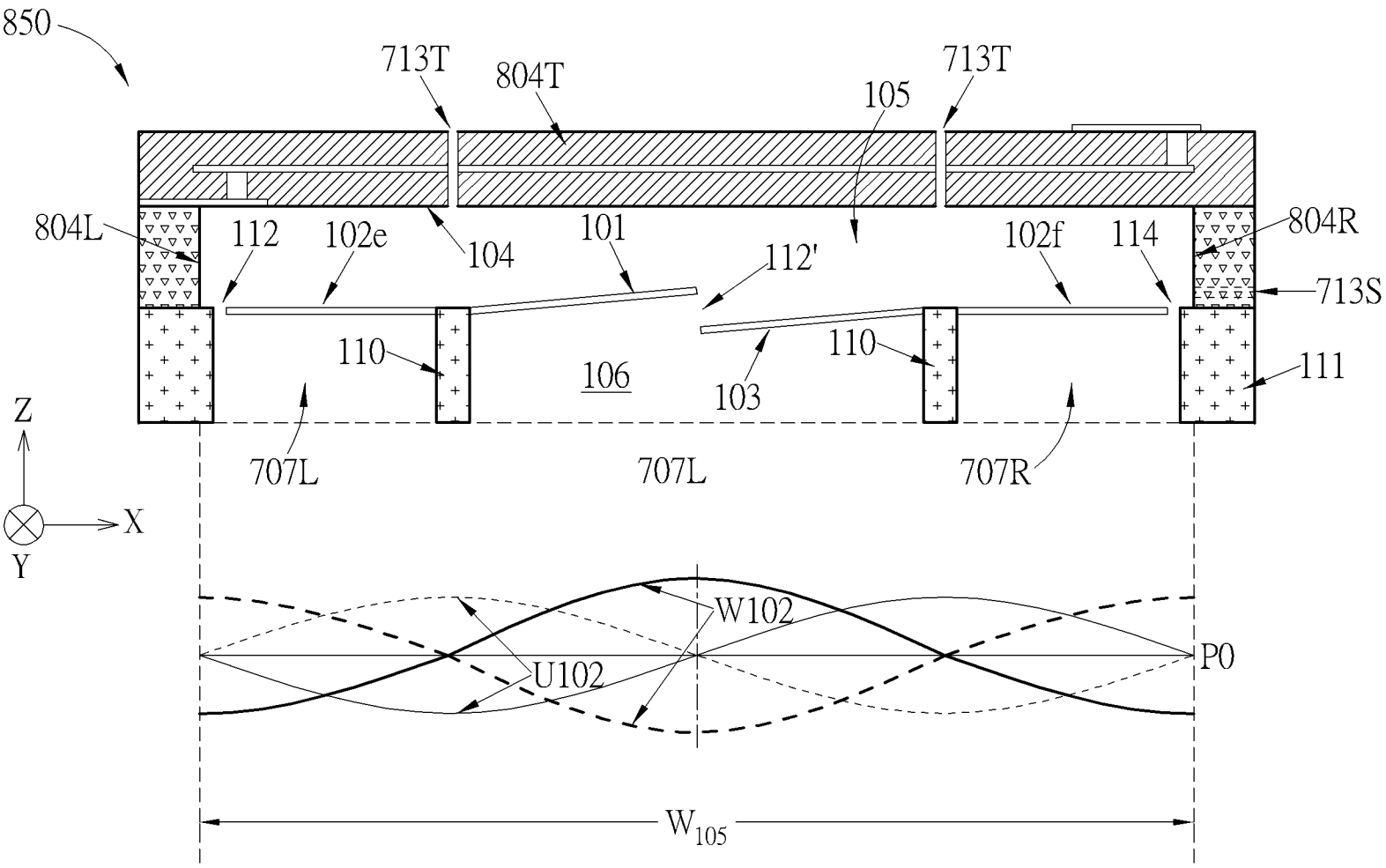

Higher harmonic resonance may occur in an air-pulse generating device. For example, FIG. 7 is a schematic diagram of a cross sectional view of an air-pulse generating device 850 according to an embodiment of the present application. In the air-pulse generating device 850, the width $W_{105}$ between the side walls 804L and 804R may be one wavelength (λ) corresponding to the operating frequency $f_{CY}$ to achieve $2^{nd}$ mode (or n=2 mode) resonance. In $2^{nd}$ mode resonance, 2 air-motion antinodes exist within the chamber 105 (for instance, at/near a quarter (¼) of the width $W_{105}$ from either side wall 804L or side wall 804R); 3 air-motion nodes locate at the center of the chamber 105 and near the side walls 804L, 804R; 2 air-pressure nodes exist within the chamber 105 (for instance, at/near a quarter (¼) of the width $W_{105}$ from either side wall 804L or 804R); 3 air-pressure antinodes locate at the center of the chamber 105 and the side walls 804L, 804R. The curve W102 schematically representing pressure distribution within the chamber 105 over time may be caused by the movement of membrane portions 102*c* and 102*d* of the air-pulse generating device 830 and symmetrical relative to a center line 703. As illustrated by W102 in FIG. 7, when a n=2 mode standing wave is formed within chamber 105 of device 850, by driving membranes 102*e* and 102*f* in synchronous with the one common waveform such as S102*a*", air-pressure waveform near sidewall 804L and 804R will be in-phase with each other and a phase inverted air-pressure waveform of similar amplitude will be produced at the center of chamber 105. The valve opening 112 of the air-pulse generating device 850 may therefore be located at/near a center location between the side walls 804L and 804R, since an air-pressure antinode is located at the center of the chamber 105 (or the width $W_{105}$). In other words, for higher harmonic resonance (namely, n≥2), in addition next to side walls 804L and 804R, opening(s) of air-pulse generating device(s) may also be at/near any air-pressure antinode between the two side walls causing resonance.

Figure 6:
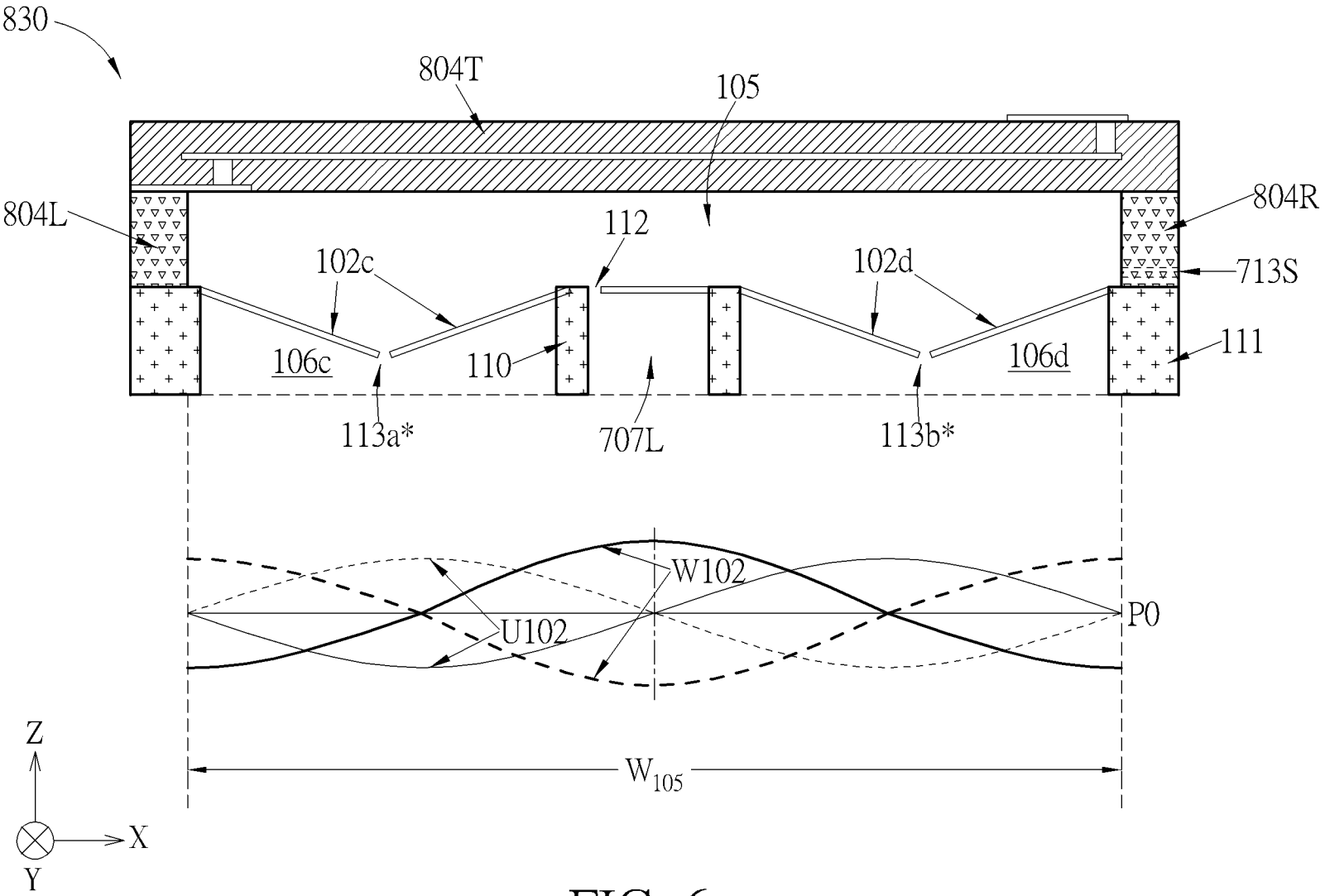
FIG. 6 and FIG. 7 are schematic diagrams of cross sectional views of air-pulse generating devices according to embodiments of the present application.

The same description of the last paragraph is also applicable to device 830 of FIG. 6.

In the air-pulse generating device, such as device 830 of FIG. 6, device 850 of FIG. 7 or device 890 of FIG. 1, the demodulation operation of the valves 101 and 103 will produce pulses of airflow which will accumulate across consecutive pulses, causing a long-term net air mass change inside chamber 105 and increase/decrease the pressure P0 within the chamber 105. Since such back pressure will cause the output SPL to drop, it is therefore suggested to release such pressure.

In the case of air-pulse generating device 830 of FIG. 6, the slit opening 113*a/113*b may be designed to be close to the air-pressure node located at $W_{105}/4$ away from the side wall 804L/804R. Due to acoustic filter effect of air-pressure node of n=2 standing wave, as illustrated by the waveform W102 crossing P0, enlarged slit 113*a/113*b will have minimum impact on the operation of device 830 while releasing the pressure build up due to the demodulation operation of the valves 101 and 103, illustrated by valve opening 112.

In the case of air-pulse generating device 850 in FIG. 7, which also operate with at frequency $f_{CY}$ corresponding to n=2 mode resonance across the width of the chamber $W_{105}$, the membranes 102*e* and 102*f* each comprise of 1 single piece of thin flap, attached to their respective support 110. As opposed to the situation in the device 830, where the membranes 102*c*, 102*d* are each made of two sub-portions, separated by slits 113*a* and 113*b* respectively, in device 850, since slits 112 and 114, created to allow free movement of membranes 102*e* and 102*f*, are located at the air-pressure anti-nodes within chamber 105 of device 850, the width of these slits needs to be minimized to suppress the leakage of air-pressure. Therefore, one or multiple vent(s) 713T can be created on the top cap, at the location(s) of the air-pressure node(s), for example, at a distance of $W_{105}/4$ away from side walls 804L and 804R. Although theoretically speaking, one such vent may suffice for the back-pressure release purpose, however, for the consideration of optimal balancing of air pressure within chamber 105, it is generally a good practice to have a pair of vents 713T, positioned in a center-mirroring fashion, as illustrated in FIG. 7.

In the case of air-pulse generating device 890 in FIG. 1, pressure pulses of the acoustic sound (e.g., the acoustic sound P890) out of the valves 112 and 113 have the same polarity, which combine together to increase/decrease the pressure P0 within the chamber 105. Therefore, vent openings 713T on the top plates, located at or near the air-pressure node, as indicated by alignment to the position where air-pressure profile W102 crosses P0, is created to allow airflow to pass through, releasing the pressure build up due to the demodulation operation of the valves 101 and 103.

The length and width of the vent opening(s) 713T may be adjusted to form a suitable acoustic low pass filter (LPF) with the volume of the chamber 105. The location of the vent opening(s) 713T may be at air-pressure node(s), relative to operating frequency $f_{CY}$, where the amplitude of frequency components corresponding to the standing wave is nearly zero. As a result, an acoustic notch filter is formed and the pressure corresponding to the amplitude modulated standing wave may be suppressed near/at the vent opening(s) 713T inside the chamber 105, and only the pressure change due to the demodulation operation may be present near/at the vent opening(s) 713T. For devices operated in the $2^{nd}$ mode resonance (e.g., the device 850), the vent opening 713T of the air-pulse may be positioned approximately at a quarter of the width $W_{105}$ ($W_{105}/4$) from either of the side walls 804R and 804L, which is different from the device operating in the $1^{st}$ mode resonance (e.g., the device 890), where the vent opening 713T (of the air-pulse generating device 890) may be near the midpoint between the two side walls 804R and 804L.

The structure of an air-pulse generating device 850 may be altered according to different design consideration. For example, the membrane 102*e*/102*f* may have two membrane sub-portions, or 2-pieces, like membrane 102*a*/102*b* or 102*c*/102*d* does, but is not limited thereto. Note that the maximum Z-direction displacement of 1-piece membrane construct, such as 102*e*/102*f* in FIG. 6, needs to be significantly smaller than the thickness (a Z-direction value) of 102*e*/102*f* to avoid leakage of the air pressure inside chamber 105. In comparison, in the 2-piece per membrane construct, since the two sub-portions always moves in tandem, such Z-direction membrane displacement limitation does not exist, meaning larger displacement may be possible and therefore lead to improved unit-device-area effectiveness (SPL per meter).

Furthermore, the valve portions 101 and 103 illustrated in FIG. 7 may be considered as a virtual valve. In other words, a slit formed between the valve portions 101 and 103, may become a temporarily formed/opened valve opening (112') when the valve portions 101 and 103 is sufficiently actuated. In addition, the temporarily formed/opened valve opening is formed periodically. When the opening is opened, the chamber and ambient environment are connected via the opening (112'). When the opening is not opened, air flowing through the slit is negligible or less than a threshold. Details of virtual valve (temporarily formed opening) may be referred to U.S. Pat. No. 11,043,197, which is not narrated herein for brevity.

In addition, similar to the device 890 shown in FIG. 1, pressure gradients are also generated in the device 850 via membrane movement and the nature of standing wave. Different from the device 890, the membrane portions 102*e* and 102*f* are actuated to move in an in-phase fashion, referring that at a certain time, both the membrane portions 102*e* and 102*f* are actuated to move upward (or downward). In this case, pressure gradients are also established by utilizing the nature of n=2 standing wave as well. Similar to description of FIG. 1, in FIG. 7, dashed lines of the curves U102 and W102 are corresponding to the time $t_0$ and solid lines of the curves U102 and W102 are corresponding to the time $t_1$. At the time $t_0$, the membrane portions 102*e* and 102*f* are actuated to move upward (in positive Z direction), pressure gradients are generated in inward direction (in X direction), as illustrated by the slope of dashed line of W102. At the time $t_1$, the membrane portions 102*e* and 102*f* are actuated to move downward (in negative Z direction), pressure gradients are generated in outward direction (in X direction), as illustrated by the slope of solid line of W102. Similarly, the membrane movement directions are substantially perpendicular to the pressure gradient directions.

Air Movement or Fan Application

The structure/mechanism of device 890/830/850 may be reproduced/adapted for an air movement or fan application. Different from an acoustic wave traveling at the speed of sound, C, an air movement is the airflow related to the kinetic movement of air particles, as that of wind, and is produced by the displacement of membrane portion(s), corresponding to membrane portions 102*a*-102*d*/102 of the air-pulse generating device 890/830/850. In an air movement or fan application/mode of these devices, air particles within the device may be described mainly according to fluid dynamics or aerodynamics; in contrast, in an air-pulse (APPS) generating application/mode of these devices, the behavior of air within the device may be described mainly according to acoustics.

For air movement or fan application, valve opening(s), such as the openings 112 and 114 illustrated in device 890/830/850, may be formed spatially on a location, and temporarily in time, such that the air motion is maximized, wherein the peak of the air motion may be in terms of the velocity of the air moved or in terms of the volume of air moved.

Driving signal(s) of the device for the air-flow generation or fan application differs from that of the APPS application. For example, in air movement or fan application, device 890 may actuate its two membranes (102*a* and 102*b*) to move synchronously, by applying the same driving signal to both membrane 102*a* and 102*b*, to create a pressure difference between the volume inside chamber 105 and the ambient outside of device 890. In comparison, in APPS application, device 890 would actuate its two membranes (102*a* and 102*b*) to move symmetrically, in opposite direction(along Z axis), by applying two interleaved (such as S102*a*, S102*b*) or polarity inverted (such as S102*a*", −S102*a*") driving signals to membrane 102*a* and 102*b*, to create pressure gradient (vector 116) within chamber 105, atop the two membranes.

A key difference between these two modes of operation lies in the different relationship between the chamber dimension and the operating frequency of device. As described in association with device 890/830/850 for APPS application, the operating frequency may be selected to produce a standing wave of mode n within chamber. In other words, the operating frequency $f_{CY}$ is related to chamber width W105 by equation $W_{105}=n/2\cdot\lambda_{CY}$, where $\lambda_{CY}=C/f_{CY}$ is the characteristic length or wavelength of $f_{CY}$ and n is a small positive integer such as 1~3. On the other hand, for the air movement or fan application of device 890/830/850, the conversion rate of membrane movement into airflow generally increases as the ratio $\lambda_{CY}/W_{chamber}$ increases, where $W_{chamber}$ is the chamber width of the device, corresponding to width of the chamber 105, $W_{105}$, of the air-pulse generating device 890/830/850. In other words, the conversion rate of membrane movement into airflow typically increases when the pressure within the chamber of the air-flow generating device for the air movement or fan application (corresponding to the chamber 105 of the air-pulse generating device 890/830/850) becomes more uniform, exactly opposite to the desire to maximize the pressure gradient (or the nonuniformity of the pressure within chamber 105) of the air-pulse generating device 890/830/850.

For example, in the air-pulse generating device 890, $W_{105}=\lambda_{CY}=3.6$ mm at operating frequency of 96 KHz since the resonance frequency f of a cantilever beam may be related to its length L by $f\propto 1/L^3$. On the other hand, by lowing the operating frequency of the air-pulse generating device for the air movement or fan application from 96 KHz down to 24 KHz and lowering the resonance frequency of both the membrane portion(s) and the valve portion(s) of the air-pulse generating device for the air movement or fan application also to 24 KHz, the width of the membrane portion may increase from 0.94 mm to 1.44 mm, the width of the valve portion may increase from 0.46 to 0.73 mm, and the resulting width of the chamber may be 2×(0.1+0.73+0.2)+1.44=3.5 mm, which is much shorter than the wavelength of 14.6 mm at frequency of 24 KHz, indicating a higher conversion rate of membrane movement into airflow. Therefore, despite almost identical cross-section view, an air-pulse generating device for the air movement or fan application with the resonance frequency of 24 KHz for both the membrane portion(s) and the valve portion(s) and driving both membrane portions of the air-pulse generating device for the air movement or fan application with the same waveform at 24 KHz may be suitable for air moving applications while the air-pulse generating device 890, where the membrane portion 102*a* and 102*b* are driven by interleaved waveforms S102*a*', S102 *b*' or symmetrical waveforms S102*a*", −S102*a*" to produce near-0 net air movement over each operating cycle $T_{CY}$, may be optimized for sound production applications and not suitable as an air movement apparatus.

In a word, while symmetrical membrane displacements of the membrane portion 102*a*/102*b* or 102*c*/102*d* of device 890 may be used to maximize the in-chamber pressure gradient for APPS applications, synchronous/identical membrane displacement (by driving membrane portions with signal of the same polarity) may be adopted to maximize the conversion rate of membrane movement to airflow. In another perspective, for APPS applications, the chamber width (in X direction) $W_{105}$ may be equal or close to $n/2\times\lambda_{CY}$ (where n is a small positive integer) in order to maximize its acoustic output by leveraging chamber resonance (i.e. standing wave); on the other hand, for air movement applications, the chamber width (in X direction) of an air-pulse generating device for the air movement or fan application may be much smaller than $\lambda_{CY}/2$ to maximize the conversion rate of membrane movement to airflow.

Figure 8:
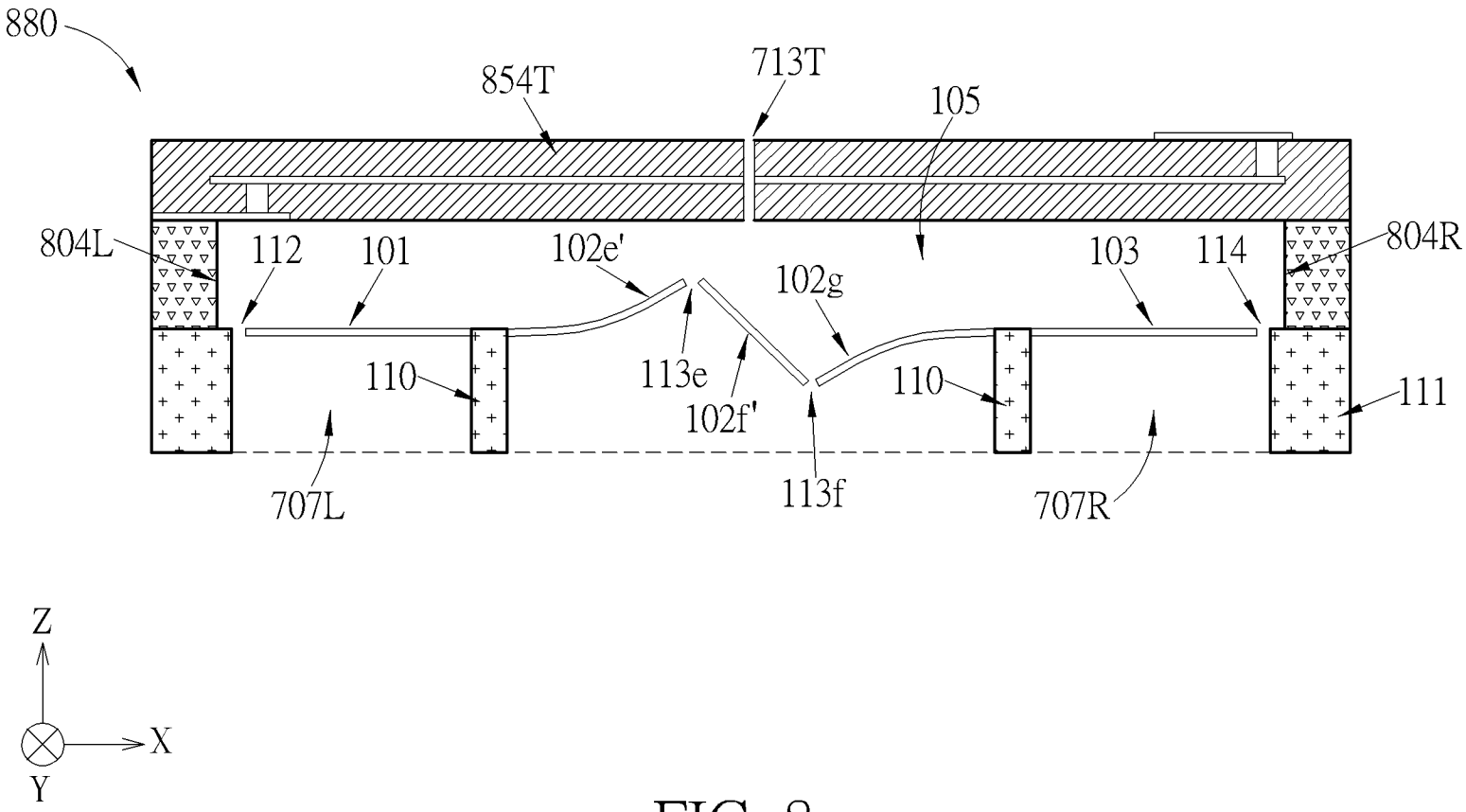
FIG. 8 and FIG. 9 are schematic diagrams of cross sectional views of air-pulse generating devices according to embodiments of the present application.

Different structural embodiments (air-pulse generating) device are described in the following paragraph. For example, FIG. 8 is a schematic diagram of a cross sectional view of an air-pulse generating device 880 according to an embodiment of the present application. The membrane structure 12 of the air-pulse generating device 880 includes one membrane portion, which is divided into membrane subparts 102$e'$, 102$f'$ and 102$g$. The membrane subparts 102$e'$ and 102$g$ may be differentiated according to slits 113$e$ and 113$f$ on the membrane portion. The membrane structure 12 of the air-pulse generating device 880 with the membrane subparts 102$e'$ and 102$g$ may serve/function as the membrane portions 102$a$ and 102$b$ of the air-pulse generating device 890 (or the membrane portions 102$c$ and 102$d$ of the air-pulse generating device 830).

For APPS applications, the membrane subparts 102$e'$ and 102$g$ may be driven by a pair of membrane driving signals similar to the membrane driving signal pair (S102$a$, S102$b$)/(S102$a'$, S102$b'$)/(S102$a''$, S102$b''$), such that the membrane subparts 102$e'$ and 102$g$ may move almost oppositely to have symmetrical membrane displacements. Similar to the membrane portion 102$a$ bending downwards and the membrane portion 102$b$ bending upwards, the membrane subparts 102$e'$ and 102$f'$ may be curved concavely to bend downwards while the membrane subparts 102$f'$ and 102$g$ may be curved convexly to bend upwards, and vice versa.

Figure 9:
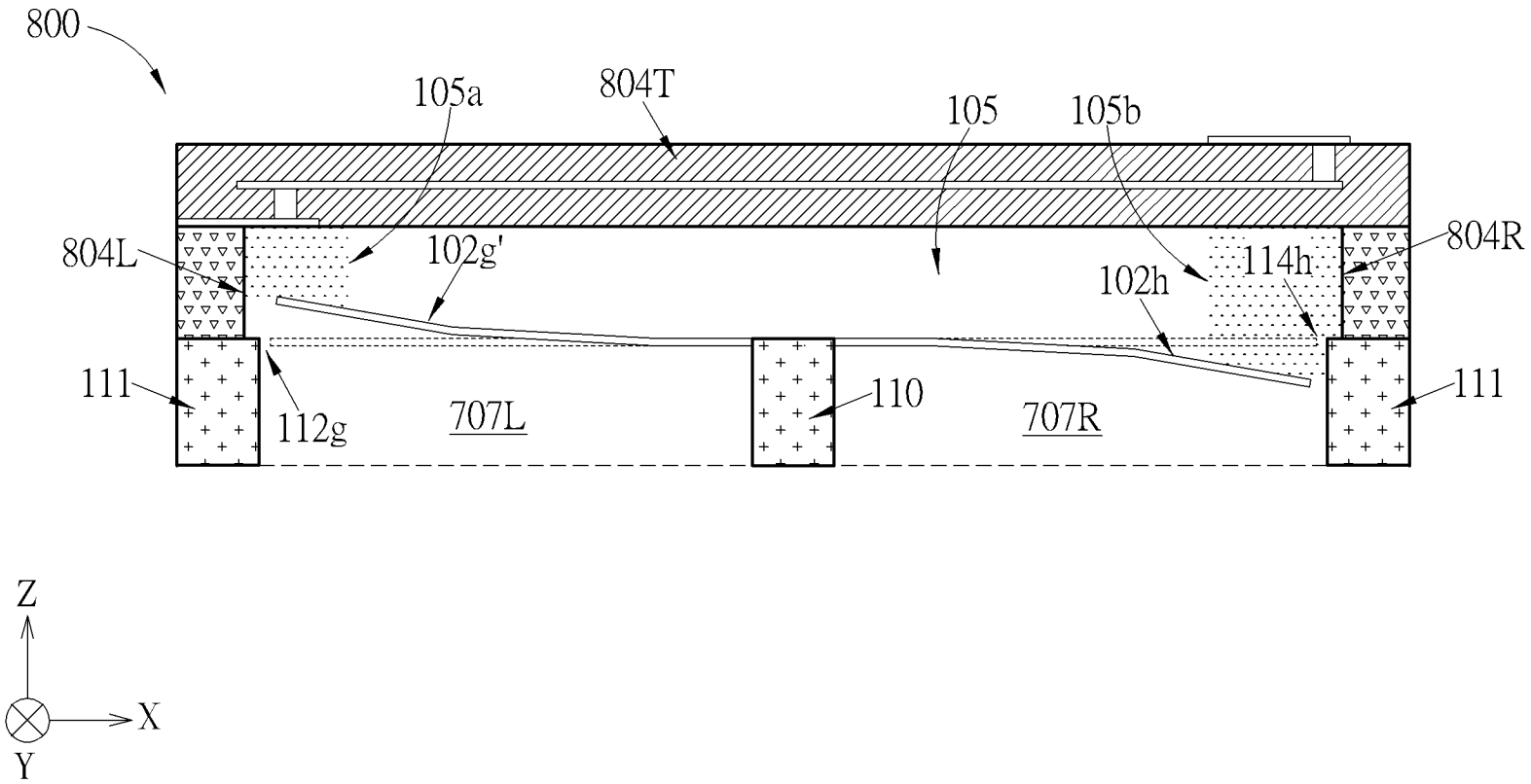

FIG. 9 is a schematic diagram of a cross sectional view of an air-pulse generating device 800 according to an embodiment of the present application. The membrane structure 12 of the air-pulse generating device 800 includes membrane portions 102$g$ and 102$h$, which are anchored on the support 110 at the center of the air-pulse generating device 800. The slits/tips of the membrane portions 102$g$ and 102$h$ are located close to the side wall 804L and 804R.

The valves 101 and 103 of the air-pulse generating device 890/830/850/880 are absent from the air-pulse generating device 800. When the membrane portions 102$g$ and 102$h$ are driven by the pair of the membrane driving signals (S102$a$, S102$b$)/(S102$a'$, S102$b'$)/(S102$a''$, S102$b''$), the membrane portions 102$g$ and 102$h$ may provide the pressure regulation function of the valves 101, 103 of the air-pulse generating device 890 and the pressure generation function of the membrane portions 102$a$, 102$b$ of the air-pulse generating device 890 by utilizing the slits between the membrane portions 102$g$, 102$h$ and the walls 111 to perform the AM ultrasonic carrier rectification function of the openings 112, 114 of the valves 101, 103 of the air-pulse generating device 890.

As a result, the membrane portion 102$g$ may vibrate to form opening 112$g$ functioned as the opening 112 of the valve 101 and meanwhile create the maximum/minimum change in pressure (e.g., the first peak pressure $pk_1$). The membrane portion 102$h$ may vibrate to form the opening 114$h$ functioned as the opening 114 of the valve 103 and meanwhile create the maximum/minimum change in pressure (e.g., the second peak pressure $pk_2$).

The air pressure waveform P707L may be expressed as $P707L \propto (S_{IN} \cdot \sin(\omega \cdot t) + Z_{0AC})^2$ when $Z102a > Z_{O/C}$ and P707L=0 otherwise. The air pressure waveform P707R may be expressed as $P707R \propto (S_{IN} \cdot \sin(-\omega \cdot t) + Z_{0AC})^2$ when $Z102b > Z_{O/C}$ and P707R=0 otherwise. Herein, waveforms Z102$a$, Z102$b$ represent displacement of the membrane portions 102$g$, 102$h$ respectively; waveform P707L, P707R represent air pressure at the ports 707L, 707R (out of the chamber 105) respectively.

A negative bias voltage may be applied to bottom electrode(s) of actuator(s) of the membrane portion 102$g$/102$h$, such that the position of (the tip of) the membrane portion 102$g$/102$h$ in the Z direction is lifted to be equal to or slightly above the displacement level $Z_{O/C}$ when the input AC voltage is 0V. In other words, $Z_{0AC}$ may be positive. If the position of (the tip of) the membrane portion 102$g$/102$h$ in the Z direction is below the displacement level $Z_{O/C}$ when the input AC voltage is 0V, $Z_{0AC}$ may be negative, and a clipping phenomenon similar to class-B amplifiers may occur to low level input signal(s). In the clipping phenomenon, the membrane portion 102$g$/102$h$ may not be fully opened.

When $Z_{0AC}$ is a positive number, an aggregated on-axis output acoustic pressure of the air-pulse generating device 800 (namely, P800=P707R+P707L) may be expressed as:

$$P800 \propto (S_{IN} \cdot \sin(\omega \cdot t) + Z_{0AC})^2 + (S_{IN} \cdot \sin(-\omega \cdot t) + Z_{0AC})^2 = S_{IN}^2 \cdot (1 - \cos^2(2\omega \cdot t)) + 2 \cdot Z_{0AC}^2 \text{ when } |S_{IN} \cdot \sin(\omega \cdot t)| < Z_{0AC} \quad \text{(eq. 5a)},$$

$$P800 \propto (S_{IN} \cdot \sin(\omega \cdot t) + Z_{0AC})^2 \approx \tfrac{1}{2} S_{IN}^2 \cdot (1 - \cos^2(2\omega \cdot t)) + 2 \cdot S_{IN} \cdot \sin(\omega \cdot t) \cdot Z_{0AC} \text{ when } |S_{IN} \cdot \sin(\omega \cdot t)| >> Z_{0AC} \quad \text{(eq. 5b), and}$$

$$P800 \propto (S_{IN} \cdot \sin(\omega \cdot t))^2 \approx \tfrac{1}{2} S_{IN}^2 \cdot (1 - \cos^2(2\omega \cdot t)) \text{ when } Z_{0AC} \to 0+ \quad \text{(eq. 5c)}.$$

$Z_{0AC}$ is the membrane displacement relative to the displacement level $Z_{O/C}$ when the input AC voltage is 0V.

In an embodiment, $Z_{0AC}$ may be set to a small positive value to reduce the second term $2 \cdot Z_{0AC}^2$ in eq. 5a and the inaudible second term $2 \cdot S_{IN} \cdot \sin(\omega \cdot t) \cdot Z_{0AC}$ in eq. 5b. For example, $Z_{0AC}$ may range between 1%~10% of the maximum membrane displacement.

In an embodiment, to compensate the nonlinearity of $S_{IN}^2$ in eq. 5a to eq. 5c, linearity compensation may be performed by a DSP function block embedded within a host processor.

By setting $Z_{0AC}$ to a small positive value, the membrane portion 102$g$/102$h$ may be slightly open when the input AC voltage is 0V. Given the symmetricity of the membrane driving signal (S102$a$, S102$b$)/(S102$a'$, S102$b'$)/(S102$a''$, S102$b''$), at least one of the openings 112$g$, 114$h$ may be slightly open/formed at any time. Therefore, the pressure change inside the chamber 105 due to the rectification effect of the openings 112$g$, 114$h$ may be balanced, and the vent opening(s) 713T or the wider slit openings 113$a$*/113$b$* may be absent from the air-pulse generating device 800.

In the air-pulse generating device 800, whether resonance occurs in the chamber 105 or not, the effect of full-wave rectification and synchronous demodulation may be produced by the air-pulse generating device 800. Even without any standing wave to create the maximum acoustic pressure at or near the side walls 804L and 804R, such maximum acoustic pressure may occur simply as a result of the physical location of the openings 112$g$, 114$h$ of the membrane portions 102$g$, 102$h$ and the symmetrical membrane driving signals (S102$a$, S102$b$)/(S102$a'$, S102$b'$)/(S102$a''$, S102$b''$), which drive the actuators of the membrane portions 102$g$, 102$h$ to cause the maximum displacements near the side walls 804L and 804R. For example, the membrane portion 102$g$ may be actuated to compress the first part/volume 105$a$ (on the top of the membrane portion 102$g$) within the chamber 105 to maximum the local pressure. The membrane portions 102$h$ may be actuated to expand the second part/volume 105$b$ (on the top of the membrane portion 102$h$) within the chamber 105 to minimum the local pressure. The pressure profile over time within the part/volumes 105$a$ and 105$b$ may be identical to that of a standing wave in the $1^{st}$ mode resonance. In other words, the air-pulse generating device 800 may achieve full-wave rectification and synchronous demodulation without the resonance of the chamber 105, thereby increasing flexibility in the design of an air-pulse generating device.

In the air-pulse generating device 800, if resonance occurs, the output of the air-pulse generating device 800 may benefit from the standing wave of such resonance. For example, when the width $W_{105}$ of the chamber 105 of the air-pulse generating device 800 equals half of the wavelength ($\lambda/2$) corresponding to the operating frequency $f_{CY}$, a pressure profile similar to that of a standing wave may be established by the movements of the membrane portions 102*g* and 102*h* and therefore enhance the output caused by the standing wave having already established within the chamber 105.

Enclosure-Less

Since the air pulse generating device 890/850/830 do not generate a pair of out-of-phase baseband radiations, as produced by a conventional speaker (namely, a front radiation and a phase-inverted back radiation), the air-pulse generating device 890/850/830 do not require any back enclosure (whose purpose is to contain or transform to the back radiation and prevent the phase inverted back radiation from cancelling out the front radiation) as a conventional speaker does. Therefore, the air pulse generating device 890/850/830, which produces sound, can be enclosure-less.

In the case of device 890, by utilizing the $1^{st}$ mode resonance of the chamber 105 and the interleaved timing of valve opening, the air-pulse generating device 890 produces two radiations that are in-phase instead of 180° out of phase. By proper timing alignment between open timing of valve 101/103 (denoted by Z101/Z103 in FIG. 2) and pressure wave P112/P114, the phase of acoustic energy is properly phase aligned and the ultrasonic radiation is transformed to double the baseband output SPL, increases the utilization rate of the total acoustic energy, achieve effective demodulation of ultrasonic AM signal while obliterate the need for an enclosure.

Acoustic Filter

Figure 10:
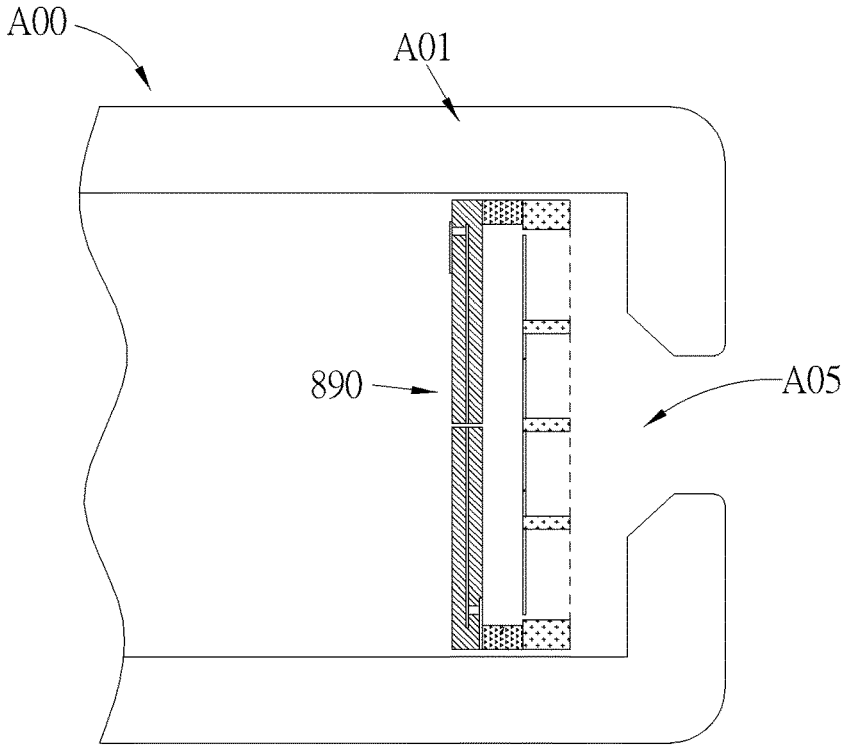
FIG. 10 and FIG. 11 are schematic diagrams of the air-pulse generating device shown in FIG. 8 disposed within constructs according to embodiments of the present application
Figure 11:
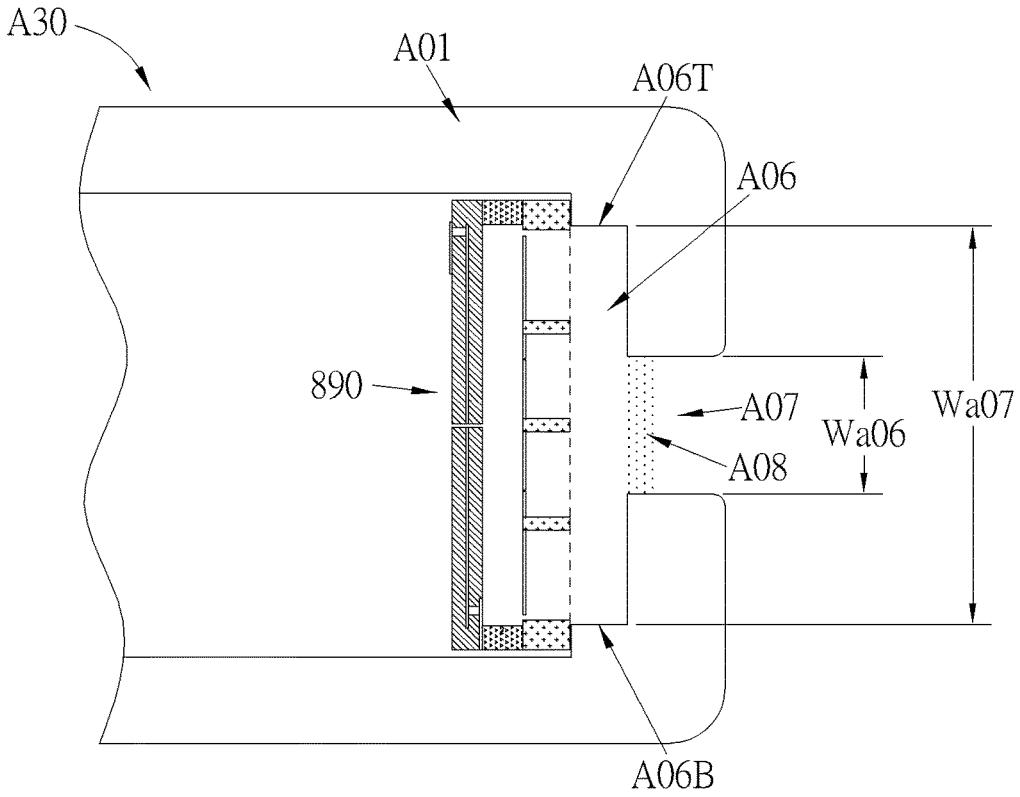

An acoustic filter may be added in front of the air-pulse generating device. For example, FIG. 10 is a schematic diagram of the air-pulse generating device 890 disposed within a construct A00 according to an embodiment of the present application. FIG. 11 is a schematic diagram of the air-pulse generating device 890 disposed within a construct A30 according to an embodiment of the present application. The acoustic air pressure measured at the ports 707L and 707R of the air-pulse generating device 890 may include not only the demodulated AM ultrasonic waves P707L and P707R but also ultrasonic waves generated by the motion of the valves 101 and 103. The symmetrical movements of the valves 101 and 103 may be characterized as a dipole. The superposition of the ultrasonic waves generated by the motion of the valves 101 and 103 may peak along the plane of the valves 101 and 103 and become null on the center plane between the side walls 804L and 804R. The construct A00/A30 may be configured to minimize the ultrasonic waves generated by the motion of the valves 101 and 103 and thus served as an acoustic filter.

In FIG. 10, the construct A00 may include a funnel structure A05 configured to filter out the ultrasonic waves generated by the motion of the valves 101/103. The funnel structure A05 may have a wide opening on the inside of the construct A00, sloping sides, and a narrow tube near the outside of the construct A00. The wide opening of the funnel structure A05 may be smaller than the width $W_{105}$ of the chamber 105. The funnel structure A05 may merge the output from the ports 707L and 707R, causing the ultrasonic waves produced by the symmetrical movement of the valves 101 and 103 to annihilate each other and leaving behind the wave P890, which is the sum/superposition of the waves P770L and P770R.

In FIG. 11, the construct A30 may include an external chamber A06 and a port A07 serving as the output port for the construct A30. The width Wa06 between side walls A06T, A06B of the external chamber A06 may equal the width $W_{105}$ of the chamber 105 (e.g., half of $\lambda_{CY}$), such that a standing wave may occur at both the frequency $f_{CY}$ (for $1^{st}$ mode resonance) and the frequency $2 \cdot f_{CY}$ (for $2^{nd}$ mode resonance). The width Wa07 of the port A07 may be smaller than the width $W_{105}$ of the chamber 105. The width Wa07 of the port A07 may be equal to half of the width $W_{105}$ of the chamber 105 or a quarter of $\lambda_{CY}$.

The construct A30 is configured to filter out the ultrasonic waves generated by the motion of the valves 101/103. For the ultrasonic waves generated by the symmetrical movement of the valves 101 and 103, which has the frequency $f_{CY}$, the acoustic energy may reside in the $1^{st}$ mode resonance of the external chamber A06 with the air-pressure node at/near the midpoint between the side walls A06T and A06B, and the pressure of the standing wave may be merged to zero over the width Wa07 of the port A07. For the acoustic wave P890, which has the pulse rate $2 \cdot f_{CY}$, the acoustic energy may reside in the $2^{nd}$ mode of the external chamber A06 with an air-pressure antinode at/near the midpoint between the side walls A06T and A06B, which is also the center of the port A07, and the maximum output pressure may be produced when the pressure of the standing wave is integrated over the width Wa07 of the port A07. By utilizing two different resonance modes, the external chamber A06 may remove the ultrasonic spectral component at the frequency $f_{CY}$ by the $1^{st}$ mode resonance and pass ultrasonic spectral component at the frequency $2 \cdot f_{CY}$ (namely, the wave P890) by the $2^{nd}$ mode resonance.

In FIG. 11, the construct A30 may include a film A08, which may be made of aquaphobia material. The film A08 may be place within the port A07 to function both as a protective means (to prevent dust, vapors and moisture from entering) and as acoustic resistance (to attenuate the remaining ultrasonic spectral component at the frequency $2 \cdot f_{CY}$ by forming a low-pass filter with the volume of the external chamber A06).

Figure 12:
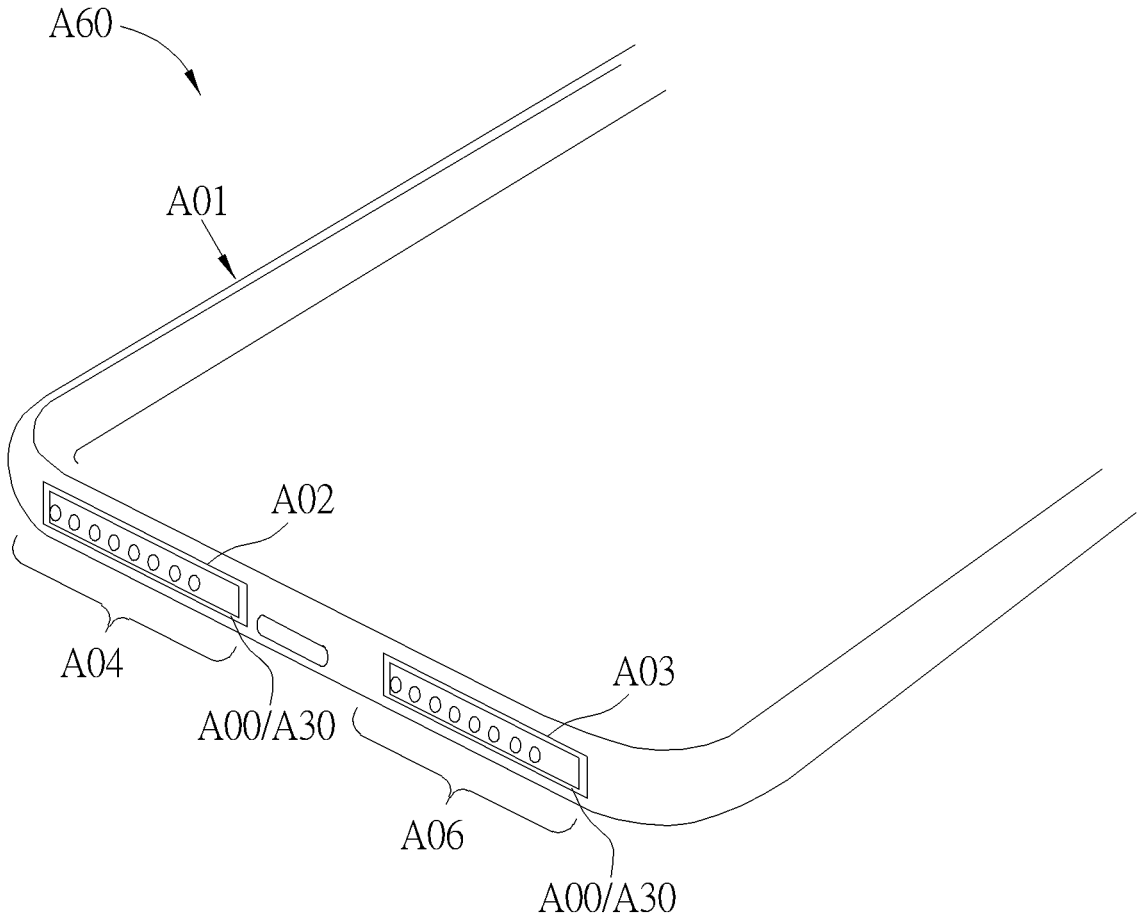
FIG. 12 is a schematic diagram of a mobile device according to an embodiment of the present application.

FIG. 12 is a schematic diagram of a mobile device A60 according to an embodiment of the present application. Two air-pulse generating devices A02 and A03, each of which may be any of the air-pulse generating devices 890/850/830, are mounted onto an edge A01 of the mobile device A60 such as a smartphone or notepad. The ports 707L and 707R of the air-pulse generating devices A02, A04 may face outward, and the ultrasonic acoustic wave produce by the air-pulse generating devices A02, A03 may pass through orifice-arrays A04, A05. The mobile device A60 may utilize the structure of the construct A00 or A30 to remove the ultrasonic spectral component at the frequency $f_{CY}$ produced by the motion of the valves 101 and 103 while allowing the wave P890 at the frequency $2 \cdot f_{CY}$ to pass through. The film A08 of the construct A30 may reduce the remaining ultrasonic spectral component around the frequency $2 \cdot f_{CY}$ further.

Figure 13:
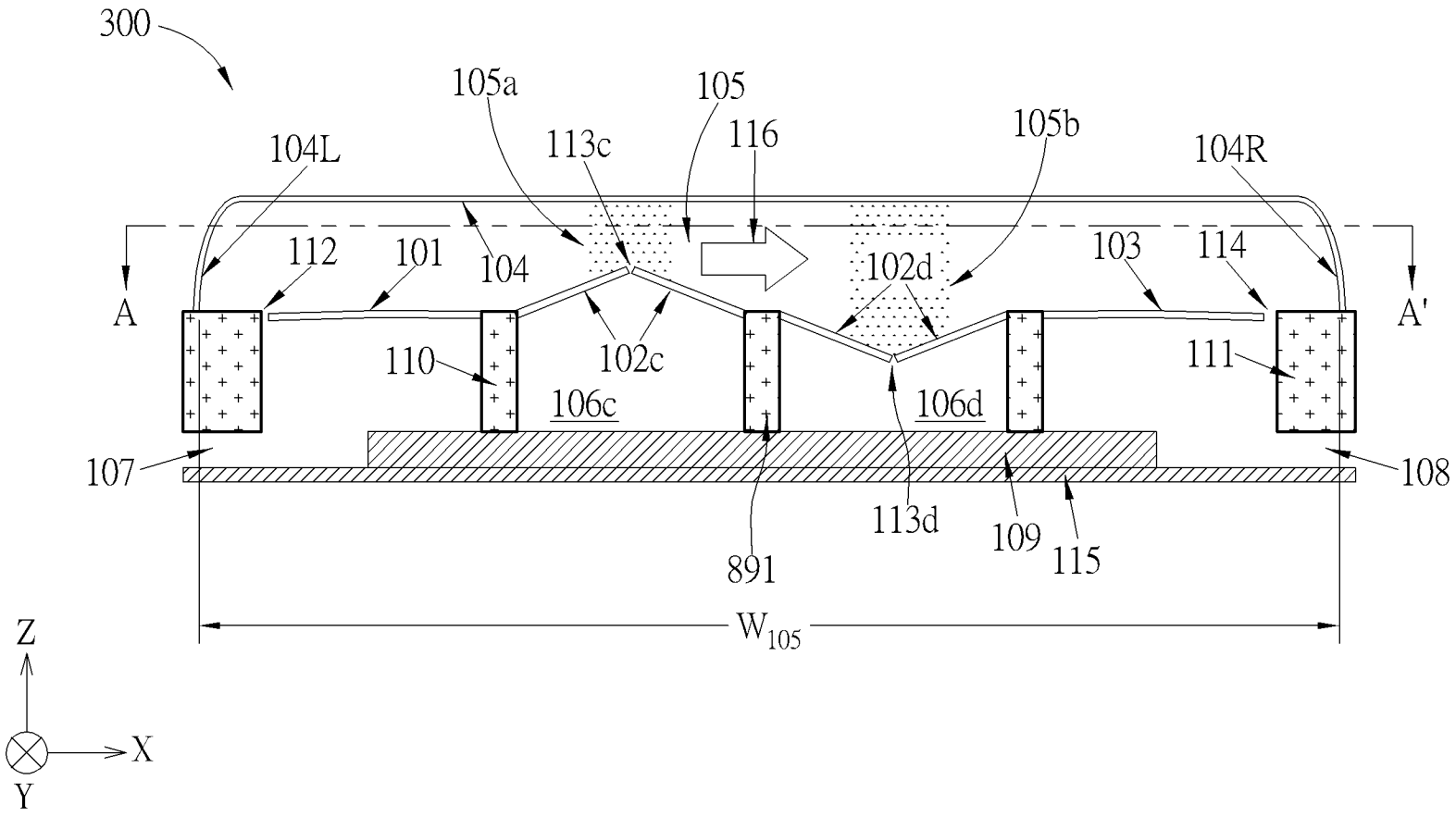
FIG. 13 to FIG. 15 are schematic diagrams of cross sectional views of air-pulse generating devices according to embodiments of the present application.

FIG. 13 is a schematic diagram of a cross sectional view of an air-pulse generating device 300 according to an embodiment of the present application. Similar to the air-pulse generating device 890, when a standing wave is formed with the chamber 105 of the air-pulse generating device 300, the movements of the membrane portions 102*c* and 102*d* of the air-pulse generating device 300 is symmetrical and may produce near 0 net air movement. Because of the near 0 net air movement over each operating cycle $T_{CY}$, most of the energy exerted by the membrane portions 102*c*/102*d* becomes acoustic energy (in the form of air pressure gradient or a standing wave) and near zero energy becomes kinetic energy (in the form of air mass movement, i.e., wind).

Figure 14:
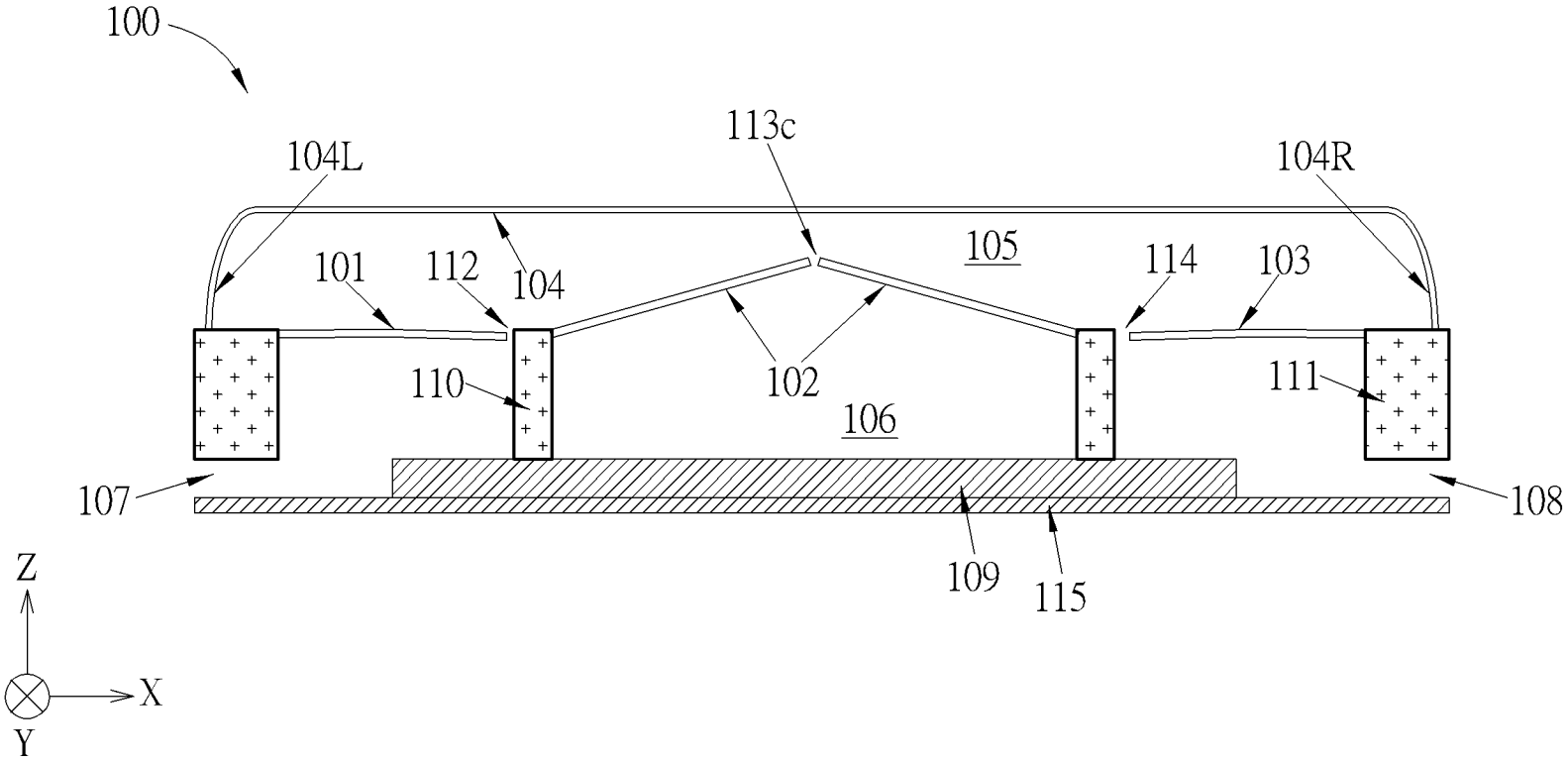

FIG. 14 is a schematic diagram of a cross sectional view of an air-moving device 100 for moving air volume from one port of the device to another port, according to an embodiment of the present application.

Contrary to the air-pulse generating device 850/890, the vibration frequency of the membrane 102 of the air-flow generating device 100 will produce a wavelength λ much greater than the width of chamber 105, and the pressure inside the chamber 105 may be considered to be uniform. The interleaved valve driving signals S101, S103 may be configured to open the valve portions 101, 103 in a time interleaved manner, or 180° out of phase, and produce air movement either from port 107 to port 108, or from port 108 to port 107. For example, if valve 101/103 is open and valve 103/101 is closed when membrane 102 moves in a positive Z direction (+Z direction) to compress the volume within chamber 105, the air will flow out of chamber 105 via port 107/108. Conversely, if valve 101/103 is opened and valve 103/101 is closed when membrane 102 moves in a negative Z direction (−Z direction) to expand the volume of chamber 105, the air will flow into chamber 105 via port 107/108.

The cap 104 of the air-moving device 100 may function as a heat dissipation plate/pad, making physical contact with heat generating components such as notebook central processing unit (CPU) or smartphone application processor(s) (AP), but is not limited thereto. The cap 104 may be made of heat conducting material such as aluminum or copper. To improve the heat transfer efficiency, fine fins (not shown) may be formed on the surface of the cap 104 inside the chamber 105, but not limited thereto.

Notably, in the air-pulse generating device 850/890, the cap 104 of the air device 100/300 is replaced by the top plate 804T and the spacers 804L, 804R which also serve as side walls. The top plate 804T may be a printed circuit board (PCB) or a land grid array (LGA) substrate and includes metal traces, vias and contact pads which may be otherwise presented on the substrate 109 or the plate 115. The thicknesses may be 0.2~0.3 mm for the top plate 804T, 0.05~0.15 mm for the side walls 804L/804R and 0.25~0.35 mm for the wall 111. The total thickness of an air-pulse generating device may be 0.6~0.8 mm, but not limited thereto.

Furthermore, pulse interleaving concept disclosed in U.S. Pat. No. 10,536,770 may be also applied in the present application. In other words, while producing ultrasonic acoustic pulses for APPS, in order to improve the quality of sound, in an embodiment, multiple air-pulse generating devices (e.g., multiple air-pulse generating devices 100) may be cascaded together to form one single air-pulse generating device. The driving signals for the air-pulse generating devices 100 (e.g., the membrane driving signal S102*a*/S102*b*/S102 or the valve driving signal S101/S103) may be interleaved to form an interleaved group and raise the effective air pulse rate to a twice higher frequency as a result, away from human audible band. For example, pulses of the membrane driving signal of one air-pulse generating device 100 may be interleaved with pulses of the membrane driving signal of another air-pulse generating device 100, such that the aggregated air pulses of one air-pulse generating device 100 may be interleaved with the aggregated air pulses of another air-pulse generating device 100 to increase the effective air pulse rate. Alternatively, each pulse of the membrane driving signal of one air-pulse generating device 100 may locate at/near a mid-point between two successive pulses of the membrane driving signal of the other air-pulse generating device 100, such that each aggregated air pulse of one air-pulse generating device 100 locate at/near a mid-point between two successive aggregated air pulses of the other air-pulse generating device 100 to increase the effective air pulse rate. In an embodiment, two air-pulse generating devices 100, each designed to operate at the operating frequency $T_{CY}$ of 24 KHz, may be placed side-by-side or attached back-to-back and driven in interleaved manner, such that the effective air pulse rate becomes 48 KHz.

Figure 15:
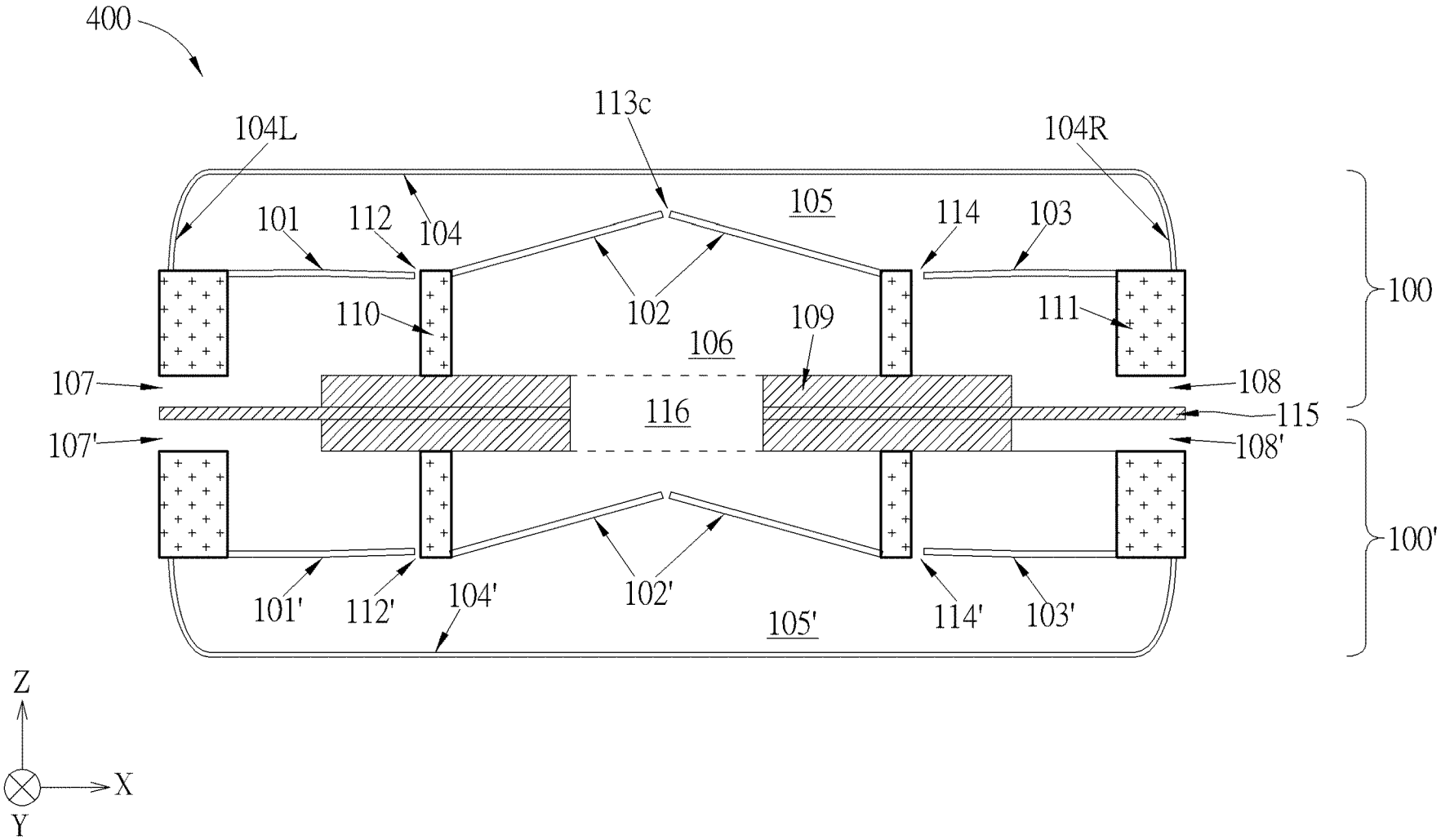

Illustratively, FIG. 15 is a schematic diagram of an air-pulse generating device 400 according to an embodiment of the present application. The air-pulse generating device 400 may be regarded as two air-pulse generating devices 100 and 100' stacked back-to-back. In the air-pulse generating device 400, two chambers 105 and 105' of the two air-pulse generating devices 100 and 100' are connected together via an opening 116 to form a chamber 106 of the air-pulse generating device 400.

The air-pulse generating device 400 may comprise a first valve portion 101, a second valve portion 103, a third valve portion 101', and a fourth valve portion 103'. A first anchor where the valve portion 101 is anchored on the wall 111 and a second anchor where the valve portion 103 is anchored on the wall 111 are aligned to the X direction; on the other hand, the first anchor and a third anchor where the valve portion 101' is anchored on the wall 111 are aligned to the Z direction. The valve portions 101 and 103 (or the valve portions 101' and 103') are symmetric with respect to the YZ plane; on the other hand, the (unactuated) valve portions 101 and 101' (or the valve portions 103 and 103') are symmetric with respect to a second plane (e.g., the XY plane) nonparallel to the YZ plane when the valve driving signal S101 (or S103) applied to the valve portions 101 and 101' drops to zero. The valve portions 101 and 101' (or the valve portion 103 and 103') are noncoplanar, while the (unactuated) valve portion 101 and 103 (or the valve portion 101' and 103') may be coplanar when the valve driving signals S101 and S103 applied to the valve portions 101 and 103 drop to zero.

In an embodiment of APPS application, by interleaving the driving signals of the two air-pulse generating devices 100, the displacement profile(s) of the membrane portion 102 (or the valve portions 101, 103) of the air-pulse generating device 400 may be mirror symmetric to the displacement profile(s) of membrane portion 102' (or valve portions 101', 103') of the air-pulse generating device 400. Alternatively, by interleaving or inverting the driving signals of the two air-pulse generating devices 100, the displacement profile(s) of the membrane portion 102 (or the valve portions 101, 103) of the air-pulse generating device 400 may be the same as the displacement profile(s) of membrane portion 102' (or valve portions 101', 103') of the air-pulse generating device 400, such that (the direction and the magnitude of) the displacement of the membrane portion 102 may equal (the direction and the magnitude of) the displacement of the membrane portion 102', causing the pressure fluctuations in the chamber 106 to be cancelled. The membrane portion 102 may be parallel to (or be offset to match) the membrane portion 102'.

In an embodiment of air moving application, the characteristic length $\lambda_{CY}$ is generally much longer than the dimension of the air-pulse generating device 400. Since the displacement of the membrane portion 102 may equal the displacement of the membrane portion 102', the air-pulse generating device 400 may include only one membrane portion, and one of the membrane portions 102, 102' may be removed, thereby reducing power consumption and improving operation efficiency.

Power Saving

In another perspective, the output of an air-pulse generating device is related to A(t)·p(t), where A(t) is the area of the opening 112/114, and p(t) represents air pressure with the chamber 105. In other words, the opening 112/114 of the valve 101/103 is directly related/proportional to the intensity of the output of an air-pulse generating device. Specifically, the maximum SPL output is a combination of the maximum of the air pressure p(t) within the chamber 105, produced by membrane movement, and the maximum of the area A(t) of the opening 112/114, produced by valve movement. By properly modulating/manipulating the area A(t), the operating power of an air-pulse generating device may be reduced.

The area A(t) may not change at a rate audible to human hearing, but may be adjusted by changing the valve driving voltage S101/S103 slowly according to the volume or the envelope of the sound being produced. For example, the valve driving voltage S101/S103 may be controlled by an envelope detection with an attack time of 50 milliseconds and a release time of 5 seconds. When the sound produced by the air-pulse generating device is consistently of low volume, the valve driving voltage S101/S103 may be gradually lowered with the (long) release time of 5 seconds. When high sound pressure is to be generated, the valve driving voltage S101/S103 may be boosted with the (short) 50-millisecond attack time.

To sum up, an air-pulse generating device of the present invention may produce an acoustic pressure (or air movement) by first vibrating its membrane structure, subsequently opening/closing its valve structure to filter/reshape the acoustic pressure (or air movement) in response to the occurrence of the maximum/minimum of acoustic pressure (or air velocity), and finally outputting a sound wave (or airflow) under a full-wave rectification effect. Synchronous demodulation may be performed by opening/closing its valve structure in a phase-locked and time-aligned manner relative to the occurrence of the maximum/minimum of acoustic pressure (or air velocity) and/or by opening/closing valve portions of the valve structure in a temporarily interleaved manner.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An air-pulse generating device, comprising:
a membrane structure and a valve structure;
a cover structure, wherein a chamber is formed between the membrane structure, the valve structure and the cover structure;
wherein an air wave vibrating at an operating frequency is formed within the chamber;
wherein the valve structure is configured to be actuated to perform an open-and-close movement to form at least one opening, the at least one opening connects air inside the chamber with air outside the chamber;
wherein the open-and-close movement is synchronous with the operating frequency;
wherein the air-pulse generating device produces an acoustic sound according to an input audio signal;
wherein the air wave within the chamber, generated by the membrane structure, comprises an amplitude-modulated waveform corresponding to a carrier component with the operating frequency and a modulation component corresponding to the input audio signal.

2. The air-pulse generating device of claim 1, wherein the membrane structure is configured to be actuated to produce the air wave according to a membrane driving signal, the membrane driving signal comprises a pulse-amplitude modulated signal, the pulse-amplitude modulated signal is generated according to the input audio signal.

3. The air-pulse generating device of claim 1, wherein
the membrane structure comprises a first membrane portion and a second membrane portion;
the first membrane portion and the second membrane portion are configured to be simultaneously actuated according to a first membrane driving signal and a second membrane driving signal, so as to produce the air wave.

4. The air-pulse generating device of claim 3, wherein
the first membrane driving signal comprises a first pulse-amplitude modulated signal, the first pulse-amplitude modulated signal comprises a plurality of first pulses temporally distributed according to the operating frequency;
the second membrane driving signal comprises a second pulse-amplitude modulated signal, the second pulse-amplitude modulated signal comprises a plurality of second pulses temporally distributed according to the operating frequency.

5. The air-pulse generating device of claim 4, wherein a first transition edge of the first pulses temporally coincides with a second transition edge of the second pulses.

6. The air-pulse generating device of claim 4, wherein the first pulses and the second pulses are temporally interleaved.

7. The air-pulse generating device of claim 3, wherein a sum of the first membrane driving signal and the second membrane driving signal is constant.

8. An air-pulse generating device, comprising:
a membrane structure and a valve structure;
a cover structure, wherein a chamber is formed between the membrane structure, the valve structure and the cover structure;
wherein an air wave vibrating at an operating frequency is formed within the chamber;
wherein the valve structure is configured to be actuated to perform an open-and-close movement to form at least one opening, the at least one opening connects air inside the chamber with air outside the chamber;
wherein the open-and-close movement is synchronous with the operating frequency;
wherein the membrane structure generates a pressure gradient with a pressure-gradient direction within the chamber during an interval;
wherein the interval is within a half of an operating cycle;
wherein the operating cycle is a reciprocal of the operating frequency.

9. The air-pulse generating device of claim 8, wherein
the pressure-gradient direction of the pressure gradient generated by the membrane structure is substantially parallel to the membrane structure.

10. The air-pulse generating device of claim 8, wherein
the membrane structure comprises a first membrane portion and a second membrane portion;
during the interval, the first membrane portion is actuated to compress a first part of the chamber and the second membrane portion is actuated to expand a second part of the chamber, such that the pressure gradient is formed in the pressure-gradient direction from the first part to the second part.

11. The air-pulse generating device of claim 8, wherein
the membrane structure generates a first air pressure gradient at a location within the chamber during a first interval within a first half of an operating cycle;

the membrane structure generates a second air pressure gradient at the location within the chamber during a second interval within a second half of the operating cycle;

the first air pressure gradient and the second air pressure gradient have opposite directions;

the operating cycle is a reciprocal of the operating frequency.

12. The air-pulse generating device of claim 11, wherein a first magnitude of the first air pressure gradient and a second magnitude of the second air pressure gradient are substantially the same.

13. An air-pulse generating device, comprising:

a membrane structure and a valve structure;

a cover structure, wherein a chamber is formed between the membrane structure, the valve structure and the cover structure;

wherein an air wave vibrating at an operating frequency is formed within the chamber;

wherein the valve structure is configured to be actuated to perform an open-and-close movement to form at least one opening, the at least one opening connects air inside the chamber with air outside the chamber;

wherein the open-and-close movement is synchronous with the operating frequency;

wherein the membrane structure comprises a membrane portion configured to be actuated to produce a membrane movement with a membrane movement direction;

wherein a pressure gradient with a pressure gradient direction is produced due to the membrane movement;

wherein the membrane movement direction and the pressure gradient direction are substantially perpendicular to each other.

14. A sound producing method, applied in an air-pulse generating device, the method comprising:

forming an air wave within a chamber, wherein the air wave vibrates at an operating frequency, and the chamber is formed within the air-pulse generating device; and forming at least one opening on the air-pulse generating device at an opening frequency, wherein the at least one opening connects air inside the chamber with air outside the chamber;

wherein the opening frequency is synchronous with the operating frequency;

wherein the step of forming the air wave at the operating frequency comprises:

forming an amplitude-modulated waveform according to an input audio signal;

wherein the amplitude-modulated waveform comprises a carrier component with the operating frequency and a modulation component corresponding to the input audio signal.

15. The sound producing method of claim 14, wherein the air-pulse generating device comprises a membrane structure, and the step of forming the air wave at the operating frequency comprises:

driving the membrane structure by a membrane driving signal, so as to produce the air wave;

wherein the membrane driving signal comprises a pulse-amplitude modulated signal generated according to the input audio signal.

16. The sound producing method of claim 14, wherein the air-pulse generating device comprises a membrane structure, the membrane structure comprises a first membrane portion and a second membrane portion, and the step of forming the air wave at the operating frequency comprises:

driving the first membrane portion by a first membrane driving signal;

driving the second membrane portion by a second membrane driving signal;

wherein the air wave is produced by simultaneously driving the first membrane portion by the first membrane driving signal and the second membrane portion by the second membrane driving signal.

17. The sound producing method of claim 16, further comprising:

generating the first membrane driving signal according to the input audio signal, wherein the first membrane driving signal comprises a first pulse-amplitude modulated signal, the first pulse-amplitude modulated signal comprises a plurality of first pulses temporally distributed according to the operating frequency;

generating the second membrane driving signal according to the input audio signal, wherein the second membrane driving signal comprises a second pulse-amplitude modulated signal, the second pulse-amplitude modulated signal comprises a plurality of second pulses temporally distributed according to the operating frequency.

18. The sound producing method of claim 17, comprising:

generating the first pulse-amplitude modulated signal and generating the second pulse-amplitude modulated signal, wherein a first transition edge of the first pulses temporally coincides with a second transition edge of the second pulses.

19. The sound producing method of claim 17, comprising:

generating the first pulse-amplitude modulated signal and generating the second pulse-amplitude modulated signal, wherein the first pulses and the second pulses are temporally interleaved.

20. The sound producing method of claim 17, comprising:

generating the first pulse-amplitude modulated signal and generating the second pulse-amplitude modulated signal, wherein a sum of the first membrane driving signal and the second membrane driving signal is constant.

21. A sound producing method, applied in an air-pulse generating device, the method comprising:

forming an air wave within a chamber, wherein the air wave vibrates at an operating frequency, and the chamber is formed within the air-pulse generating device; and forming at least one opening on the air-pulse generating device at an opening frequency, wherein the at least one opening connects air inside the chamber with air outside the chamber;

wherein the opening frequency is synchronous with the operating frequency;

wherein the air-pulse generating device comprises a membrane structure, and the step of forming the air wave at the operating frequency comprises:

generating a pressure gradient with a pressure-gradient direction, via the membrane structure, within the chamber;

wherein the pressure-gradient direction of the pressure gradient generated by the membrane structure is substantially parallel to the membrane structure.

22. The sound producing method of claim 21, wherein the step of generating the pressure gradient with the pressure-gradient direction within the chamber comprises:

generating the pressure gradient with the pressure-gradient direction within the chamber during an interval;

wherein the interval is within a half of an operating cycle;

wherein the operating cycle is a reciprocal of the operating frequency.

23. The sound producing method of claim 21, wherein the membrane structure comprises a first membrane portion and a second membrane portion, and the step of generating the pressure gradient with the pressure-gradient direction comprises:

compressing a first part of the chamber by actuating the first membrane portion during an interval;

expanding a second part of the chamber by actuating the second membrane portion during the interval;

wherein the pressure-gradient direction is from the first part to the second part.

24. The sound producing method of claim 21, wherein the step of forming the air wave at the operating frequency comprises:

the membrane structure generating a first air pressure gradient at a location within the chamber during a first interval within a first half of an operating cycle;

the membrane structure generating a second air pressure gradient at the location within the chamber during a second interval within a second half of the operating cycle;

wherein the first air pressure gradient and the second air pressure gradient have opposite directions;

wherein the operating cycle is a reciprocal of the operating frequency.

25. The sound producing method of claim 24, comprising:

generating the first air pressure gradient with a first magnitude and the second first air pressure gradient with a second magnitude;

wherein the first magnitude of the first air pressure gradient and the second magnitude of the second air pressure gradient are substantially the same.

26. A sound producing method, applied in an air-pulse generating device, the method comprising:

forming an air wave within a chamber, wherein the air wave vibrates at an operating frequency, and the chamber is formed within the air-pulse generating device; and forming at least one opening on the air-pulse generating device at an opening frequency, wherein the at least one opening connects air inside the chamber with air outside the chamber;

wherein the opening frequency is synchronous with the operating frequency;

wherein the air-pulse generating device comprises a membrane structure, and the step of forming the air wave at the operating frequency comprises:

actuating a membrane structure to produce a membrane movement with a membrane movement direction, such that a pressure gradient is formed;

wherein the pressure gradient with a pressure gradient direction is produced due to the membrane movement;

wherein the membrane movement direction and a pressure gradient direction are substantially perpendicular to each other.

27. The air-pulse generating device of claim 1, wherein the membrane structure comprises a first membrane portion;

wherein the first membrane portion is actuated according to a first membrane driving signal;

wherein the first membrane driving signal comprises pulses with alternating polarities;

wherein the polarities corresponding to the pulses alternate with respect to a constant voltage.

28. The air-pulse generating device of claim 27, wherein the membrane structure comprises a second membrane portion;

wherein the first membrane portion and the second membrane portion are actuated according to the first membrane driving signal.

29. The sound producing method of claim 14, wherein the air-pulse generating device comprises a first membrane portion, and the step of forming the air wave comprises:

driving the first membrane portion by a first membrane driving signal, so as to produce the air wave;

wherein the first membrane driving signal comprises pulses with alternating polarities;

wherein the polarities corresponding to the pulses alternate with respect to a constant voltage.

30. The sound producing method of claim 29, wherein the membrane structure comprises a second membrane portion, and the step of forming the air wave at the operating frequency comprises:

driving the second membrane portion by the first membrane driving signal, so as to produce the air wave.

* * * * *